US009371996B2

(12) United States Patent
Schmid

(10) Patent No.: US 9,371,996 B2
(45) Date of Patent: Jun. 21, 2016

(54) GRATE BAR FOR A FURNACE COMPRISING AIR DUCTS

(75) Inventor: Wolfgang Schmid, Seeshaupt (DE)

(73) Assignee: TISKA GMBH (DE)

( * ) Notice: Subject to any disclaimer, the term of this patent is extended or adjusted under 35 U.S.C. 154(b) by 0 days.

(21) Appl. No.: 13/821,905

(22) PCT Filed: Sep. 9, 2011

(86) PCT No.: PCT/IB2011/053935

§ 371 (c)(1), (2), (4) Date: Mar. 8, 2013

(87) PCT Pub. No.: WO2012/032490

PCT Pub. Date: Mar. 15, 2012

(65) Prior Publication Data

US 2013/0167762 A1 Jul. 4, 2013

(30) Foreign Application Priority Data

Sep. 9, 2010 (GB) ..... 1014974.8

(51) Int. Cl.
*F23H 7/08* (2006.01)
*F23H 17/08* (2006.01)
(Continued)

(52) U.S. Cl.
CPC ... *F23L 1/02* (2013.01); *F23H 7/08* (2013.01); *F23H 17/08* (2013.01); *F23H 17/12* (2013.01); *F23H 2900/17002* (2013.01)

(58) Field of Classification Search
CPC ..... F23H 7/08; F23H 7/06; F23H 7/10; F23H 7/12; F23H 7/14; F23H 7/16; F23H 7/18; F23H 17/08; F23H 17/02; F23H 17/04; F23H 17/12; F23H 2900/17002; F23H 2900/090401; F23H 9/06; F23H 9/08; F23H 9/12; F23H 2700/009; F23H 2700/002; F23H 1/02; F23H 1/06; F23H 11/10; F23H 11/12; F23H 11/06; F23H 11/08; F23L 1/02
USPC ..... 110/346, 348, 297, 298, 299, 300, 267, 110/268, 278, 281, 286, 289, 290, 291, 327, 110/328, 165 R, 166, 167, 168, 169, 170, 110/171; 126/152 R, 152 B, 152 A, 173, 126/163 R, 163 A, 153, 154, 160, 166, 161, 126/170–172, 176 R, 177, 178, 179, 180, 126/176 A, 174, 175, 155–159, 162, 167, 126/168, 169; 83/196, 197, 198, 199, 200, 83/566; 241/83, 84, 262, 263, 155, 164, 241/600
See application file for complete search history.

(56) References Cited

U.S. PATENT DOCUMENTS 12,967 A 5/1855 Schlough
260,028 A 6/1882 Jarvis
(Continued)

FOREIGN PATENT DOCUMENTS

DE 399913 8/1924
DE 911317 C 5/1954
(Continued)

OTHER PUBLICATIONS

DE 10 2004 0322291: partial English Machine Translation.*
(Continued)

*Primary Examiner* — Kenneth Rinehart
*Assistant Examiner* — Tavia Sullens
(74) *Attorney, Agent, or Firm* — Taylor English Duma LLP

(57) ABSTRACT

Grate bar for a furnace. The grate bar comprises a first air duct (46) at a first lateral side of the grate bar. The first air duct is provided at an angle other than 90 degrees with respect to a longitudinal axis of the grate bar.

4 Claims, 17 Drawing Sheets

Figure 1:
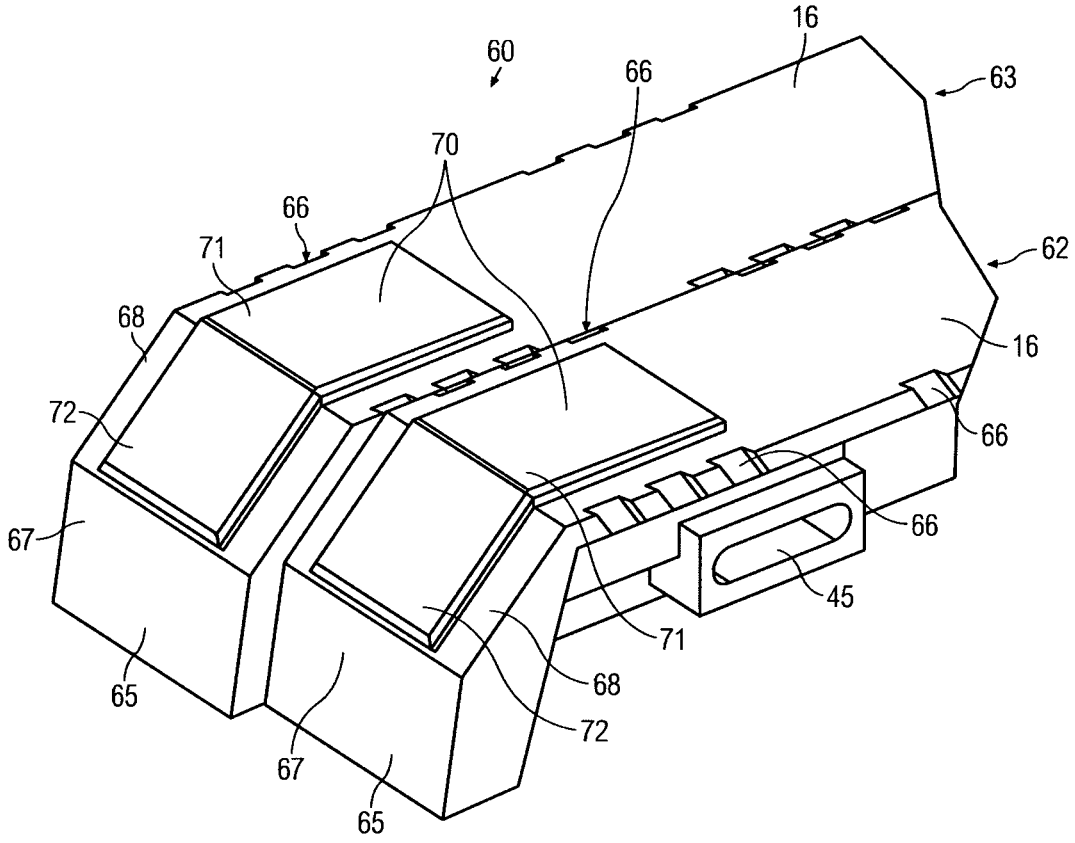

(51) Int. Cl.
*F23H 17/12* (2006.01)
*F23L 1/02* (2006.01)

(56) References Cited

U.S. PATENT DOCUMENTS

| | | | | | |
|---|---|---|---|---|---|
| 561,097 | A | * | 6/1896 | Dunn | 110/282 |
| 621,373 | A | * | 3/1899 | Poillon | 126/163 R |
| 1,306,729 | A | | 6/1919 | Waid | |
| 1,435,948 | A | * | 11/1922 | Van Brunt | 110/328 |
| 1,481,366 | A | * | 1/1924 | Herkenrath | 126/163 R |
| 1,491,811 | A | | 4/1924 | Miller | |
| 1,584,721 | A | * | 5/1926 | Bland | 241/263 |
| 2,016,869 | A | * | 10/1935 | McCrone | 126/167 |
| 2,403,787 | A | | 7/1946 | Carroll | |
| 3,985,084 | A | * | 10/1976 | Delaplace | 110/281 |
| 4,103,627 | A | | 8/1978 | Mainka | |
| 4,239,029 | A | | 12/1980 | Martin et al. | |
| 4,240,402 | A | | 12/1980 | Martin et al. | |
| 4,450,952 | A | | 5/1984 | Steiner | |
| 4,520,792 | A | * | 6/1985 | Weber | 126/175 |
| 4,793,471 | A | * | 12/1988 | Bartels | 110/281 |
| 2008/0163860 | A1 | * | 7/2008 | Simper | 126/163 R |

FOREIGN PATENT DOCUMENTS

| | | |
|---|---|---|
| DE | 2805712 | 6/1979 |
| DE | 9309198 | 8/1993 |
| DE | 19648128 | 5/1998 |
| DE | 102004032291 | 2/2006 |
| DE | 102004034322 | 2/2006 |
| DE | 202007018707 | 4/2009 |
| FR | 642198 | 8/1928 |
| FR | 672244 | 12/1929 |
| FR | 882885 | 6/1943 |
| FR | 2622278 | 4/1989 |
| GB | 2014285 | 8/1978 |
| GB | 1014974.8 | 9/2010 |
| WO | 0221049 | 3/2002 |
| WO | 2006117478 | 11/2006 |
| WO | 2012032492 | 3/2012 |

OTHER PUBLICATIONS

English Machine Translation: FR 882885. Accessed Oct. 31, 2014.*
"Motor". In the American Heritage Dictionary of the English Language. Boston: Houghton Mifflin, 2011. <http://search.credoreference.com/content/entry/hmdictenglang/motor/0>.*
Schmid, Wolfgang; International Preliminary Report on Patentability for PCT/IB2011/053935, filed Sep. 9, 2011, mailed Sep. 12, 2012, 17 pgs.
Schmid, Wolfgang; International Search Report for PCT/IB2011/053935, filed Sep. 9, 2011, mailed Dec. 23, 2011, 5 pgs.
Schmid, Wolfgang; International Preliminary Report on Patentability for serial No. PCT/IB2011/053942, filed Sep. 9, 2011, mailed Sep. 12, 2012, 21 pgs.
Schmid, Wolfgang; International Search Report for serial No. PCT/IB2011/053942, filed Sep. 9, 2011, mailed Dec. 22, 2011, 4 pgs.
Schmid, Wolfgang; U.S. Patent Application entitled: Grate Bar for a Furnace Comprising Engaging Means, filed Mar. 8, 2013, having U.S. Appl. No. 13/821,898, 80 pgs.
Schmid, Wolfgang; Final Office Action for U.S. Appl. No. 13/821,898, filed Mar. 8, 2013, mailed Jul. 14, 2014, 25 pgs.
Schmid, Wolfgang; Non-Final Office Action for U.S. Appl. No. 13/821,898, filed Mar. 8, 2013, mailed Jan. 30, 2014, 61 pgs.
Schmid, Wolfgang; Non-Final Office Action for U.S. Appl. No. 13/821,898, filed Mar. 8, 2013, mailed Apr. 6, 2015, 16 pgs.
Schmid, Wolfgang; Final Office Action for U.S. Appl. No. 13/821,898, filed Mar. 8, 2013, mailed Jul. 21, 2015, 20 pgs.
Schmid, Wolfgang; Applicant Interview Summary for U.S. Appl. No. 13/821,898, filed Mar. 8, 2013, mailed Jan. 20, 2016, 3 pgs.

* cited by examiner

GRATE BAR FOR A FURNACE COMPRISING AIR DUCTS

The present application relates to grate bars for use in furnaces. Especially, but not exclusively, the present application relates to grate bars for reciprocating grates.

Among others, the present application relates to an arrangement of interconnected grate bars using a coupling means with an elongated recess on the side of one grate bar and an engaging element on the abutting side of a neighbouring grate bar, which limits or prevents the lifting up relative to neighbouring grate bars and the tilting and falling down of broken grate bar pieces.

DE 20 2007 018 707 U1 describes a roller grate with stationary grate elements that form the cylindrical surface of the roller grate.

FR2599125 describes a grate bar in which interconnection between neighbouring grate bars is at the distal end.

DE3049086, U.S. Pat. No. 4,239,029 and DE3610819A1 describe arrangements of interconnected grate bars in which no relative movement between neighbouring bars is possible.

U.S. Pat. No. 4,240,402 describes an arrangement in which an interconnection between neighbouring grate bars allows pivotal movement of one grate bar with respect to the other, but not longitudinal planar movement. DE2805712 describes an arrangement of interconnected grate bars, each having two coupling means at proximal and distal ends of the grate bar, however only one of the coupling means has an elongated groove to allow longitudinal movement of one bar with respect to its neighbour.

FR2599125 describes an arrangement of interconnected grate bars which is only located at the distal end of the bars.

DE1783200 describes an arrangement of interconnected grate bars in which the coupling means is integrated with ribs disposed on the under side of the grate bars.

DE911317 describes an arrangement of interconnected grate bars in which neighbouring bars can move longitudinally relative to one another, the side of the grate bars being modified to form engaging hooked lips. However, there is only a relatively small longitudinal area of interconnection.

In a further development, the grate bars according to the application comprise engaging elements which engage with coupling means of horizontally adjacent grate bars to provide a relative movement of the grate bars for the improved transport of waste material and for the comminution of material that has fallen between the grate bars. The engaging elements may comprise sharp edges for an improved comminution of material that has been trapped between adjacent grate bars. Furthermore, lateral aeration grooves of the grate bars may have opposing inclinations between horizontally adjacent grate bars to provide a scissor effect for the comminution of trapped material.

Furthermore, the grate bars according to the application comprise an arrangement of two interconnections, one at the proximal end and the other at the distal end of the grate bar, to prevent a broken grate bar from falling onto the base.

U.S. Pat. No. 4,239,029 describes an arrangement of interconnected grate bars in which there is one interconnection along the longitudinal axis. Likewise, DE911317 discloses an arrangement in which the interconnection means is at one location along the longitudinal axis of the grate bar.

As described earlier, DE2805712B1 refers to a means of interconnection in which there are two coupling means, one at the proximal and one at the distal end.

According to a further aspect, the sides of the grate bar are adapted with lateral grooves, that may be inclined for cutting and disposal of combusted material, and for self-cleaning of the lateral grate bar surface. U.S. Pat. No. 4,520,792 describes an arrangement of two or more grate bars having sides adapted to have teeth and tooth spaces for comminution of material resting on the upper surface of the grate bars as one grate bar moves longitudinally in relation to the neighbouring grate bar. Here and in the following, the term "comminution" refers to mechanical shredding or pulverizing of waste, as for example in solid and waste water treatment.

DE634810 describes an arrangement of stationary and movable grate bars such that gaps between sides of neighbouring stationary and movable grate bars vary in configuration as the movable grate bar moves relative to the stationary grate bar, thereby effecting cutting of material which falls into the gaps.

According to a further aspect, the application discloses a grate bar having a modification to improve air flow in the region beneath and between neighbouring grate bars, (see especially FIGS. 1, 6, 7 and FIGS. 9-11). Air channels or air ducts or lateral grooves are provided along the whole length of the grate bar. DE2806974 describes a grate bar with internal channels for circulating air.

DE102004034322 describes an arrangement, which allows for air flow between grate bars.

DE19648128 and EP1315936B1 describe a grate bar having internal channels within the grate bar for circulation of a coolant liquid.

WO06117478, DE9309198 and DE102004032291 describe a grate bar with fins integrated underneath the upper side to define one or more paths for air flow within the grate bar.

Among others, the application provides a grate bar for a furnace that comprises a first air duct or groove at a first lateral side of the grate bar. Herein, a lateral side refers to a side of the grate bar that is facing a neighbouring grate bar and which generally has a vertical orientation, as opposed to an upper side, a lower side or and end face of the grate bar. The first air duct is provided at an angle other than 90 degrees with respect to a longitudinal axis of the grate bar, which is approximately the direction of relative movement of neighbouring grate bars.

The inclination of at least one neighbouring groove against the vertical is made such that an edge of the first air duct together with an edge of a corresponding neighbouring air duct of a neighbouring part forms a cutting arrangement for particles that are caught in the area of the first air duct and the neighbouring air duct. In a specific embodiment, an inclination relative to the vertical is about 30°.

In a further modification, the grate bar comprises further air ducts at the first side of the grate bar which have substantially the same inclination as the first air duct and which extend over the entire length of the first lateral side. In a further embodiment, the grate bar also comprises a second air duct at a second lateral side of the grate bar which is opposite to the first lateral side. The second air duct has an inclination which is substantially different from the inclination of the first air duct.

In an alternative embodiment, the inclination of the grooves on the second lateral side may also be substantially the same as the inclination of the first air duct. As for the first lateral side, the second lateral side may also comprise further air ducts which have substantially the same inclination as the second air duct and which extend over the entire length of the second lateral side.

To achieve a good cutting effect, the air duct or at least one of the air ducts may be provided with a rectangular cross section or also a straight or a rounded saw tooth shaped cross section.

The application also discloses a grate for a furnace with an arrangement of fixed and movable grate bars which comprise the abovementioned air ducts, especially one in which the fixed and movable grate bars are alternated within horizontal rows and wherein the horizontal rows of fixed and movable grate bars are provided on fixed and movable step frames.

In a more specific embodiment of a grate according to the application, at least two neighbouring grate bars of the arrangement comprise lateral air ducts such that there is a cutting angle between the air ducts of one of the neighbouring grate bars and the air ducts of the other one of the neighbouring grate bars. Especially, the air ducts may be provided at an inclination of about 60° against the horizontal, which gives a good compromise between cutting action and air transport. The surfaces in which the air ducts are provided may be smoothed such that the grates can be placed close together and less waste is trapped.

Furthermore, the application also discloses a furnace with the abovementioned grate. The furnace may be fuelled with coal, biologic material, or other combustion material with a high heating value and the heat may be used to for power generation and/or teleheating. Furthermore, the application discloses a waste incineration plant with the abovementioned grate.

A grate according to the application is used in the following way. A movable step frame and a fixed step frame are provided. Furthermore, an array of alternating fixed and movable grate bars is provided on the movable step frame and the fixed step frame, wherein horizontally adjacent grate bars are movably connected via engaging members that engage into elongated recesses and. The grate bars are also provided with lateral air ducts that are slanted differently between adjacent sides of horizontally adjacent grate bars.

An alternating movement between neighboring grate bars is generated and the movement is used to move supporting members of the movable step frame. Fixed grate bars are moved with the supporting members of the movable step frame. A supporting member engages into a space between a downwardly extending hook and a proximal modified region of a fixed grate bar Movable grate bars are moved relative to supporting members of the movable step frame, wherein a supporting member engages into a space between a downwardly extending portion and a nose of the movable grate bar. Material particles in a region between the neighboring grate bars are cut by edges of corresponding air ducts.

In a further aspect, the application discloses a grate bar for a furnace, the grate bar comprising at least one but preferentially a plurality of air ducts which extends along at least one longitudinal side of the grate bar from its lower surface to its upper surface such that combustion gas can stream from underneath the grate bar to above it. Different from the prior art, the air ducts are provided in a side face of the grate bar which is facing towards a side face of a neighbouring grate bar. Moreover, the air ducts may be formed straight to enable a good airflow and removal of trapped material.

According to a modification the air ducts are essentially evenly distributed along the at least one side. The air ducts may form groups of equidistant air ducts which are essentially evenly distributed along the at least one side.

In one embodiment, the grate bar comprises at least eight air ducts on one side of the grate bar. Ventilation is also possible with less air ducts but with eight air ducts or more than that, for example in three groups of three air ducts, there is an improved ventilation.

The air ducts may extend from below the upper surface of the grate bar to an upper surface of the grate bar. The upper layer of the grate bar is relatively thin. This provides short air ducts that are less likely to be choked by combustion material. In one embodiment, the air ducts are also inclined against the longitudinal axis of the grate bar to generate a cutting effect between neighbouring grate bars.

The application moreover discloses a grate of several grate bars which comprise the aforementioned grooves wherein at least two neighbouring surfaces of neighbouring grate bars comprise air ducts with differing inclination. Air or combustion gas is injected into a combustion material on top of a grate of a furnace by blowing the air or combustion gas into a space below the grate and conducting the air to the upper side of grate bars along side faces of grate bars of the grate. Especially, the method may comprise conducting air through one or more air ducts which are provided at one or more lateral faces of the grate bars.

Provided that obstructions in and above the ducts are substantially equal the air flow can be adjusted such that there is a substantially equal airflow through air ducts of a grate bar.

According to a further aspect, the distal end of a grate bar is fitted with a removable end-cap to eliminate the need for grate bar replacement when the grate bar end wears.

U.S. Pat. No. 812,071, CH663266A5, FR2694376 and FR2530319 all describe arrangements of removable grate bar end caps.

It is an object of the application to provide improved grate bars for use in a furnace. The application discloses a grate bar for a furnace that comprises a proximal elongated recess at a first lateral side of the grate bar. Herein "proximal" refers to the driven side, which is driven either directly via a moving step frame or indirectly via another grate bar at a first lateral side of the grate bar. The elongated recess may have a closed shape or may also be provided by just two longitudinal projections that are facing each other to form a groove.

The grate bar further comprises a proximal engaging element at a second side of the grate bar which is opposite to the first side. The proximal elongated recess is provided in a longitudinal direction of the grate bar such that a corresponding neighbouring proximal engaging element of a first neighbouring part is movable within the proximal elongated recess in the longitudinal direction relative to the grate bar. Herein, the neighbouring part can be another grate bar or a step frame and the longitudinal direction is the direction in which the grate bar has the longest extension. The "ends" are in this case defined by two opposing points where the engaging member first touches the elongated recess when one is rotated relative to the other.

The proximal engaging element has a longitudinal shape with a first end and a second end, wherein the height of the proximal engaging element at the first end and at the second end is slightly smaller than the height of a corresponding proximal elongated recess of a further neighbouring part. More specifically, the further neighbouring part can be provided at opposite sides of the first neighbouring part.

A relative tilt angle between neighbouring grate bars is determined by the height difference of elongated recess and the engaging element and the geometrical shape of the engaging element. Advantageously, the tilt angle is such that a broken piece of a grate bar does not contact the underlying grate frame, for example less than 45° degrees.

The grate bar according to the application may furthermore comprise a distal elongated recess and a distal engaging element. "Distal" refers to a location close to the opposite side to the proximal side of the grate bar where the grate bar slides freely on a further grate bar. Preferably, the distal elongated recess is provided also at the first side of the grate bar and the distal engaging element is preferably also located at the second side of the grate bar. The distal engaging element can have the same shape as the proximal engaging element and the distal elongated recess can have the same shape as the proximal elongated recess. Preferentially, the engaging elements are fixed with respect to grate bar in order to prevent tilting and uplifting of the grate bar. The elongated recesses may be cast as part of a side of the grate bar.

In a further modification, at least one coupling element is adapted to the corresponding engaging element of the first neighbouring grate part such that the elongated recess can only tilt relative to the engaging element of the first neighbouring part by a tilt angle that does not exceed a maximum tilt angle. Furthermore, at least one engaging element is adapted to the corresponding coupling element of the second neighbouring part such that the engaging element can only tilt relative to the elongated recess of the second neighbouring part by a tilt angle that does not exceed the maximum tilt angle.

In a more specific embodiment, a height of the rectangular cross section of the engaging element is slightly smaller than the height of the corresponding elongated recess of the neighbouring part and a width of the rectangular cross section—or a longitudinal distance between the first end and the second end—is greater than the height of the corresponding elongated recess. By making the height slightly smaller, the engaging element can move within the elongated recess and by making the width greater than the height of the elongated recess the engaging element can lock at a tilting angle.

In a further embodiment, at least one of the engaging elements has an octagonal cross section and a height of the octagonal cross section is slightly smaller than the height of the corresponding elongated recess of the neighbouring part and a width of a longitudinally aligned surface of the engaging element that is parallel to a longitudinal axis of the engaging element is greater than the height of the corresponding elongated recess.

More generally, the engaging element may have two parallel horizontal faces and at least one oblique face, that is at an angle to the parallel faces. Waste particles are cut by movement against the oblique face and the parallel faces provide alignment of neighbouring grate bars.

In a further modification, at least one of the engaging elements has a bone shaped cross section, the bone shaped cross section comprising two widened ends, wherein a height of the widened ends is slightly smaller than the height of the corresponding elongated recess of the neighbouring part and a maximum distance of the widened ends is greater than the height of the corresponding elongated recess.

In a further embodiment, the proximal engaging element is provided next to a proximal end of the grate bar and the distal engaging element is placed next to a distal end of the grate bar. Furthermore, the proximal end of the grate bar is in contact with a supporting element that may be driven or fixed and the distal end of the grate bar is in contact with an upper surface of a further grate bar.

Especially, the abovementioned elongated recesses may be formed out as a gap between two longitudinal protrusions that extend along the grate bar. Alternatively, the elongated recesses are formed out as a proximal elongated recess and a distal elongated recess which have an O-shaped cross section or which have a rectangular cross section. Thereby, less material is needed, reducing the overall weight.

Especially, the recess or recesses may be formed out as protrusions of a main body of the grate. At least one engaging element may comprise a bolt to fix the engaging element to the grate bar. Slanted grooves or air ducts may be provided next to at least one elongated recess. More specifically, the proximal engaging element may be provided at a distance of about 40 cm from the distal engaging element which provides a good support for a typical length of a grate bar of about 70-80 cm.

The application further discloses a grate for a furnace which comprises an arrangement of grate bars that are either fixed or movable relative to a supporting member. The fixed and movable grate bars comprise longitudinal recesses and engaging elements and the engaging elements of a grate bar engage into the longitudinal recesses of a neighbouring part. More specifically, the arrangement of fixed and movable grate bars comprises rows of fixed and movable grate bars, wherein the fixed and movable grate bars are alternated. The rows of fixed and movable grate bars are provided on either fixed or movable step frames.

In a further modification, the frame comprises engaging elements which mate with elongated recesses of grate bars that are adjacent to the frame. In another modification, the frame comprises elongated recesses which mate with engaging elements of adjacent grate bars. The application further discloses a waste incineration plant with the abovementioned arrangement of fixed and movable grate bars. A cutting effect in lateral air ducts of the grate bars supports self-cleaning and reduces lateral forces on the grate bars.

In a further aspect, the application discloses a grate bar for a furnace, comprising an exchangeable head at a distal end of the grate bar, the exchangeable head being fixed to the grate bar with at least two bolts. The bolts comprising bolt heads which engage into a first and a second T-shaped slit that are provided in the exchangeable head. The exchangeable head is provided between a first step and a second step of a receiving area of the grate bar. Thereby, the first and second steps take up thrust forces and the bolts are subjected to less strain. The slit may also take on a slightly modified form such as a Y-shape, for example.

The exchangeable head may be provided within an indentation formed out of a main body of the grate bar which has an H-shaped profile at its distal end. The at least two bolts may be provided in the form of at least one front bolt and at least one rear bolt wherein the front bolt is shorter than the rear bolt and the front bolt engages into the first T-shaped slit and the rear bolt engages into the second T-shaped slit. The bolts may be spot welded to the grate bar for fast manufacture and durable connection.

The exchangeable head may further be provided with a thrust element at a sloping surface of the exchangeable head, especially a thrust element with a triangular cross section. Furthermore, the exchangeable head may be provided with a clearing element at a horizontal surface of the exchangeable head, especially a clearing element has a triangular cross section.

Alternatively or in addition, the exchangeable head may also comprise a pyramidal portion. The bolts are provided in bores of the grate bar such that a clearance is left between the bolts and the bores.

In the following description, details are provided to describe the embodiments of the application. It shall be apparent to one skilled in the art, however, that the embodiments may be practised without such details.

Figure 2:
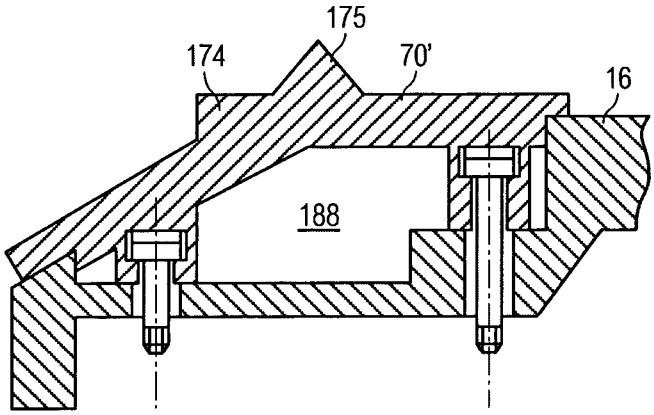
Figure 3:
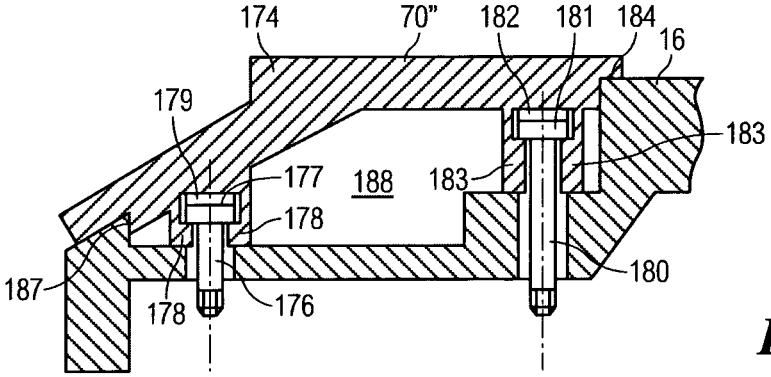
Figure 4:
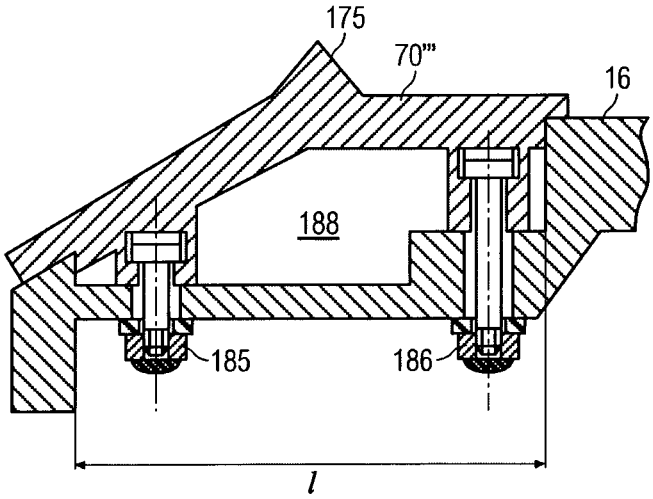
Figure 5:
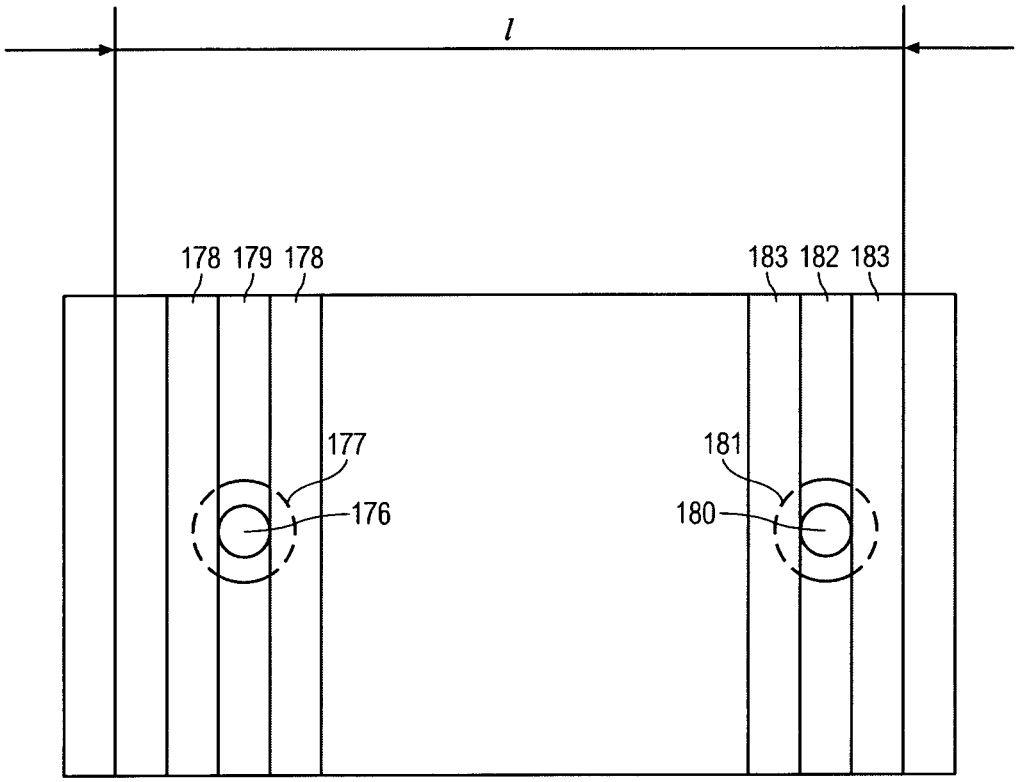
Figure 6:
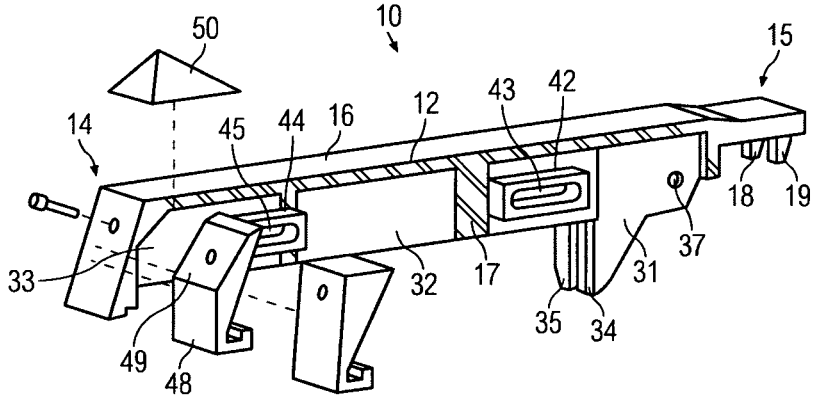
Figure 7:
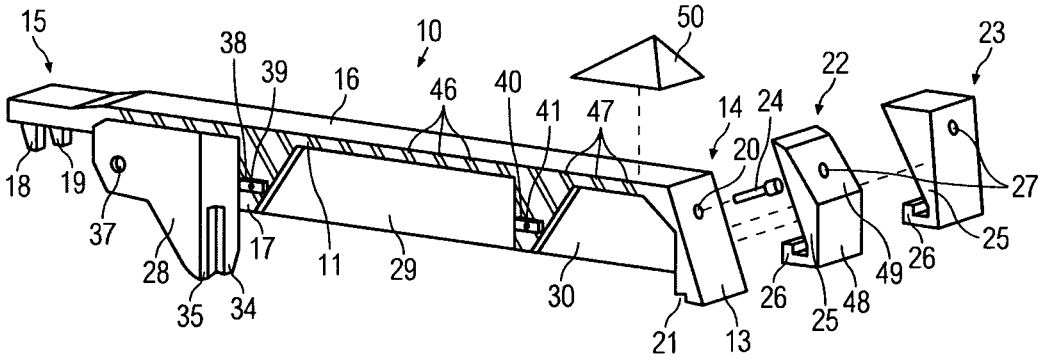
Figure 8:
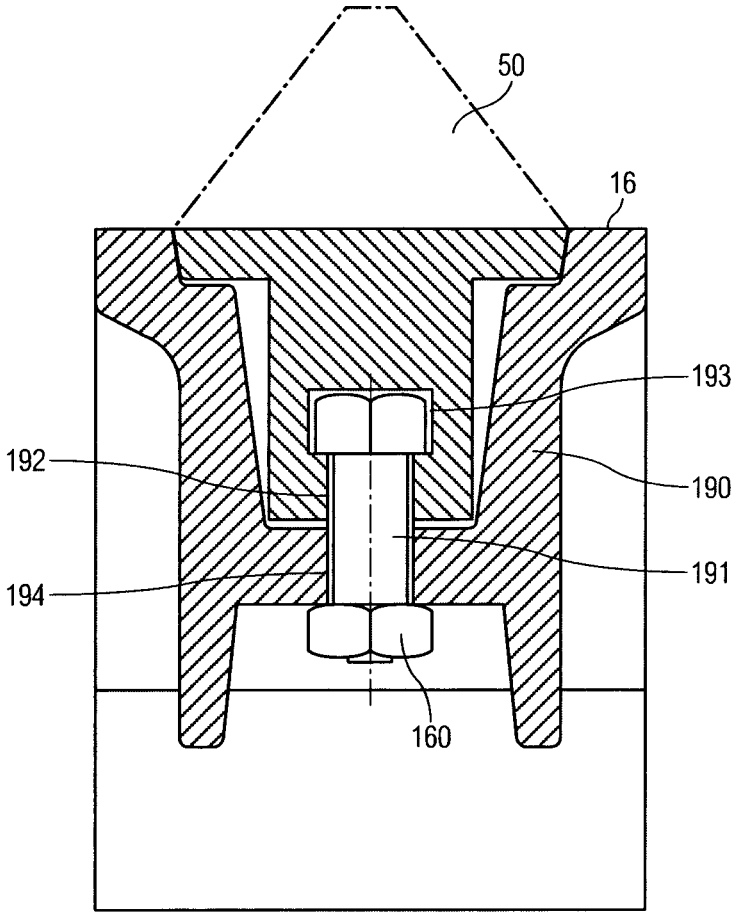
Figure 9:
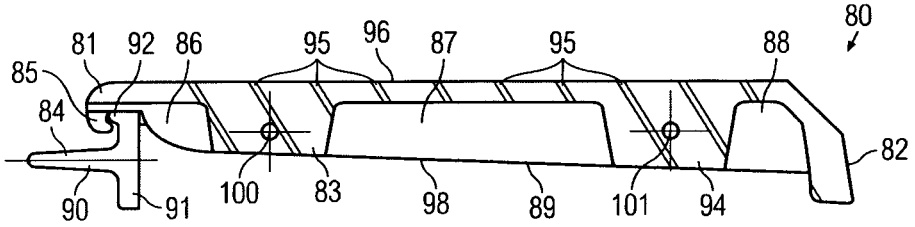
Figure 10:
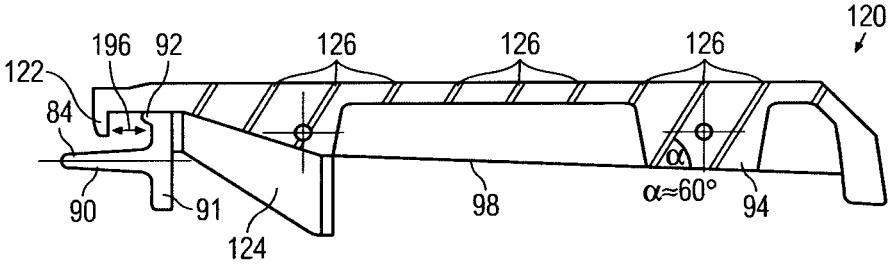
Figure 11:
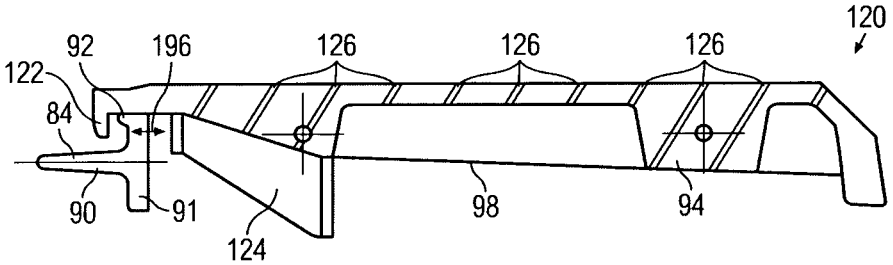
Figure 12:
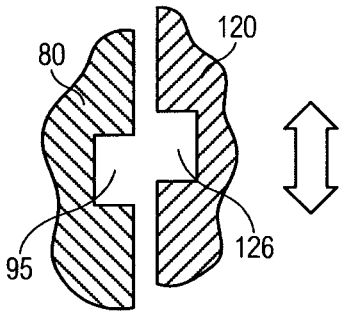
Figure 13:
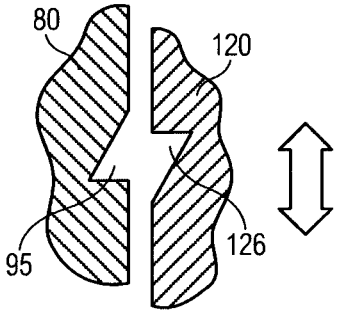
Figure 14:
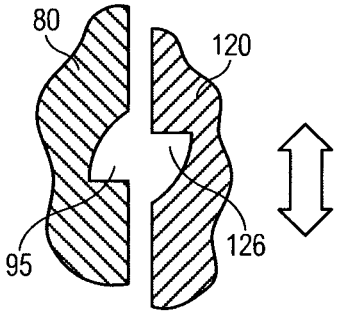
Figure 15:
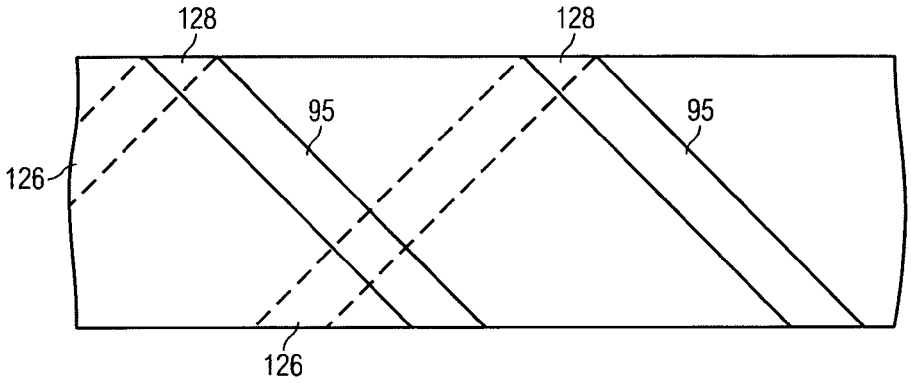
Figure 16:
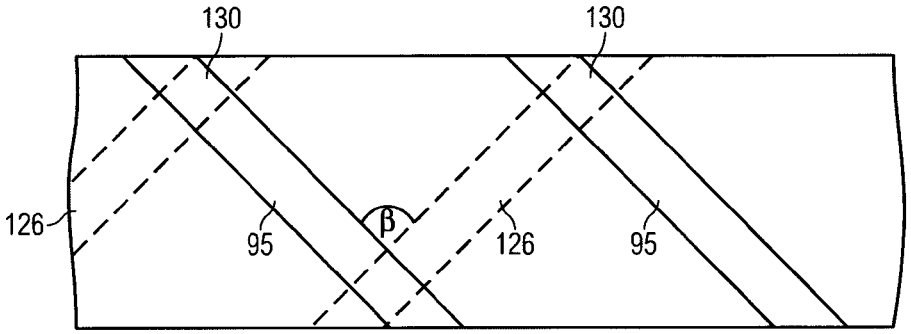
Figure 17:
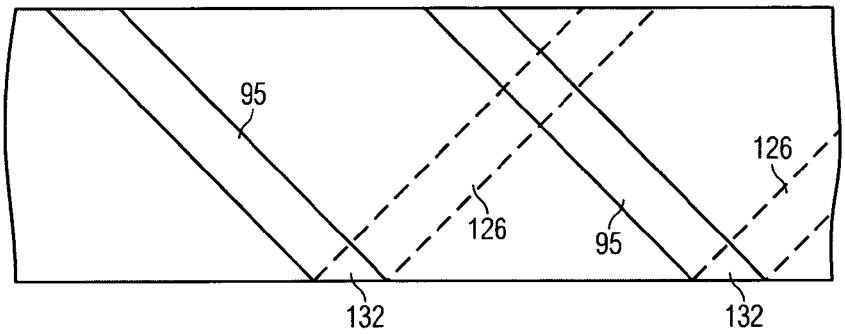
Figure 18:
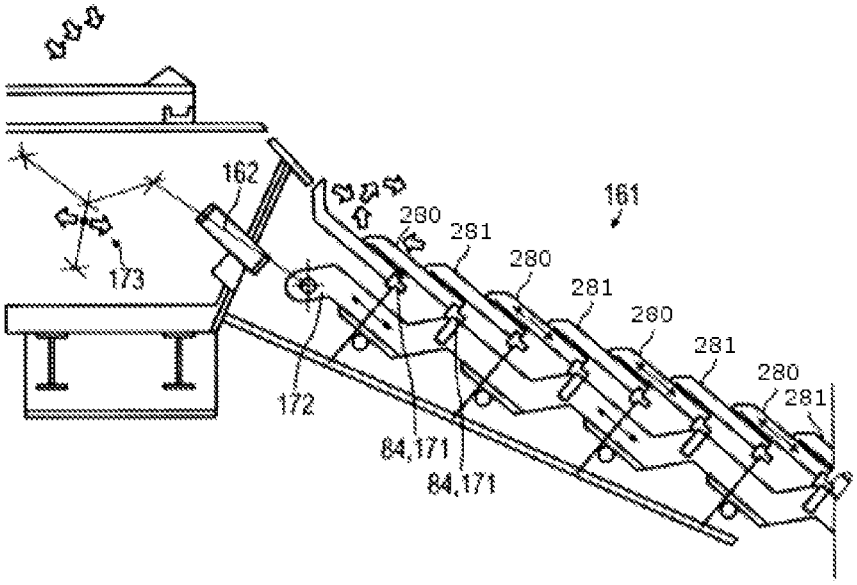
Figure 19:
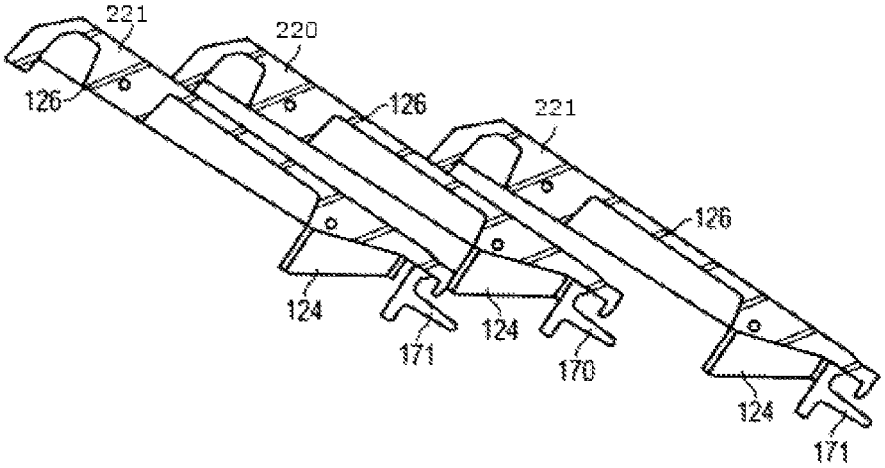
Figure 20:
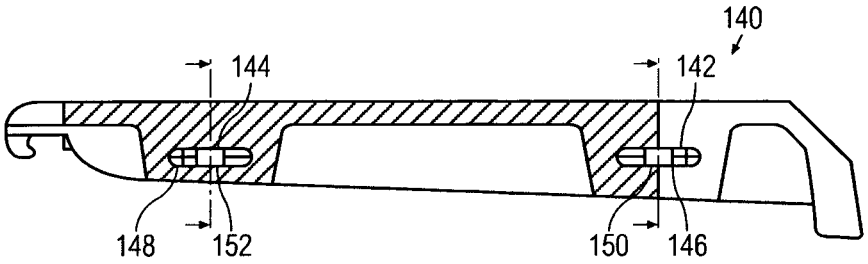
Figure 21:
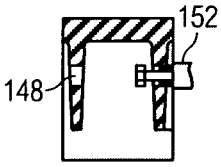
Figure 22:
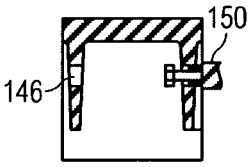
Figure 23:
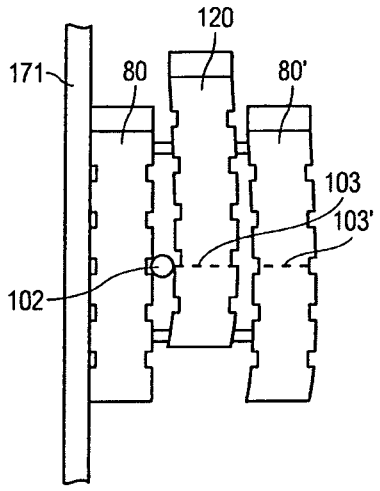
Figure 24:
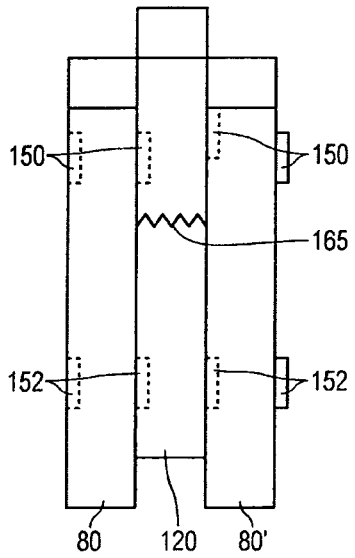
Figure 25:
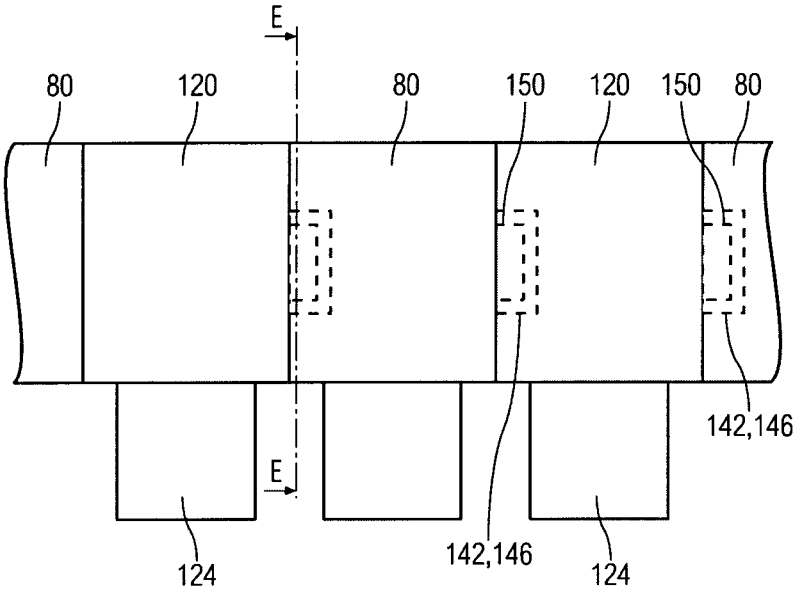
Figure 26:
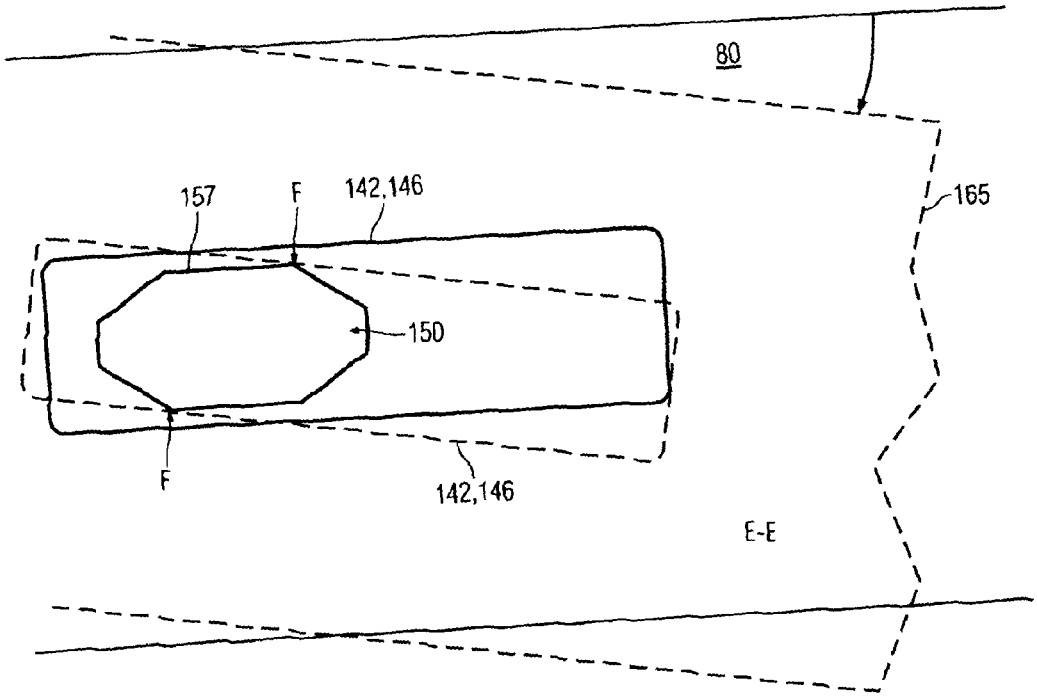
Figure 28:
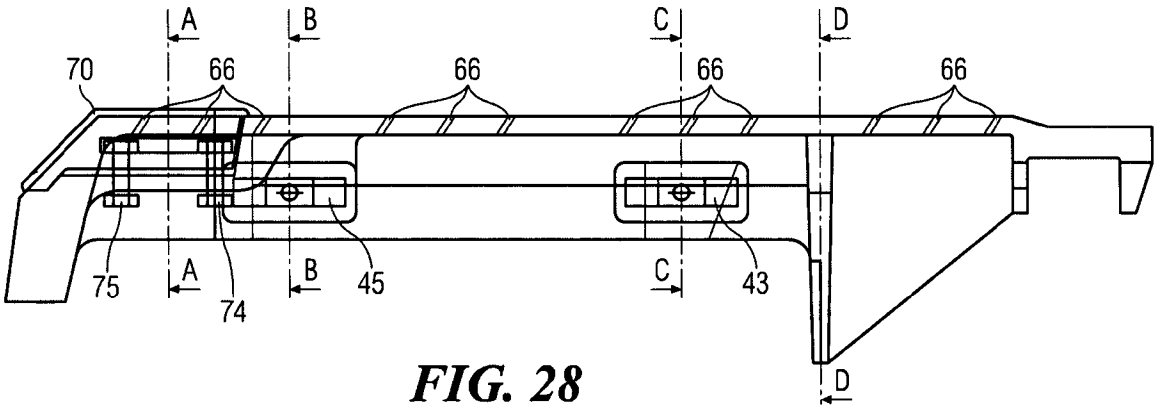
Figure 29:
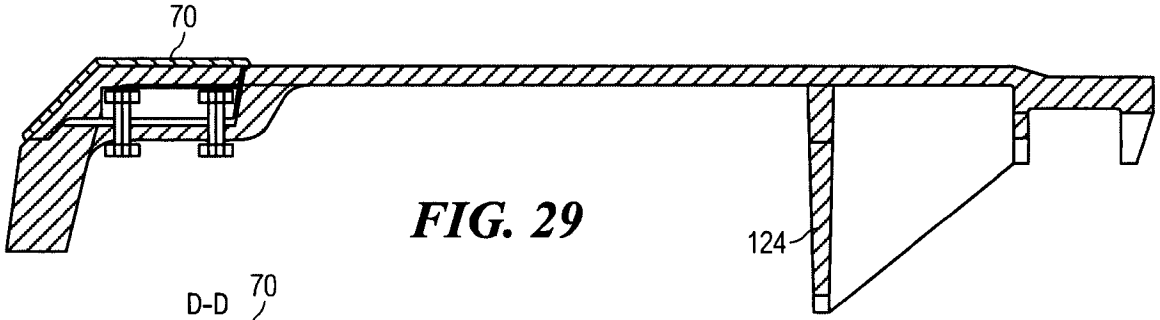
Figure 30:
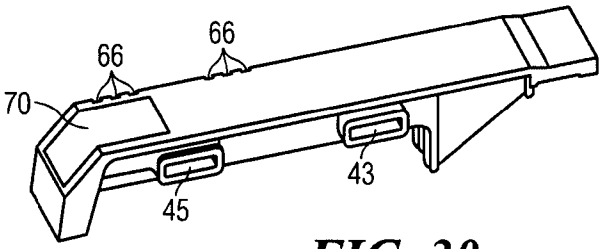
Figure 33:
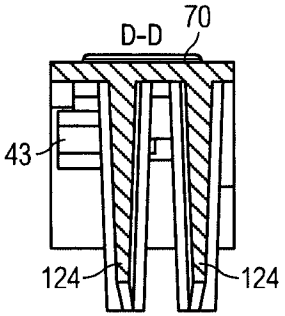
Figure 32:
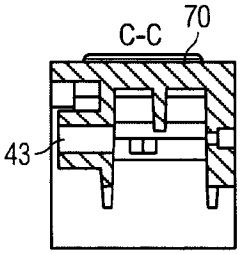
Figure 31:
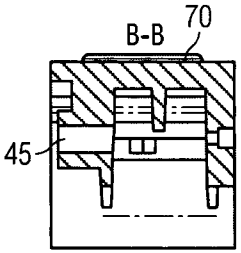
Figure 27:
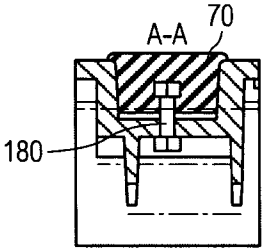
Figure 34:
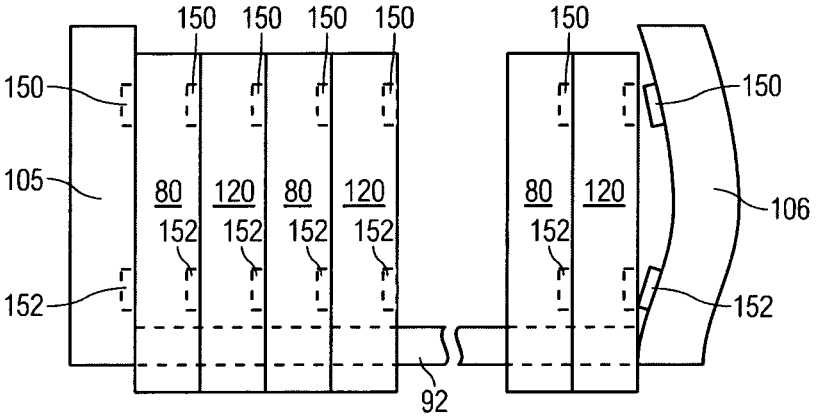
Figure 35:
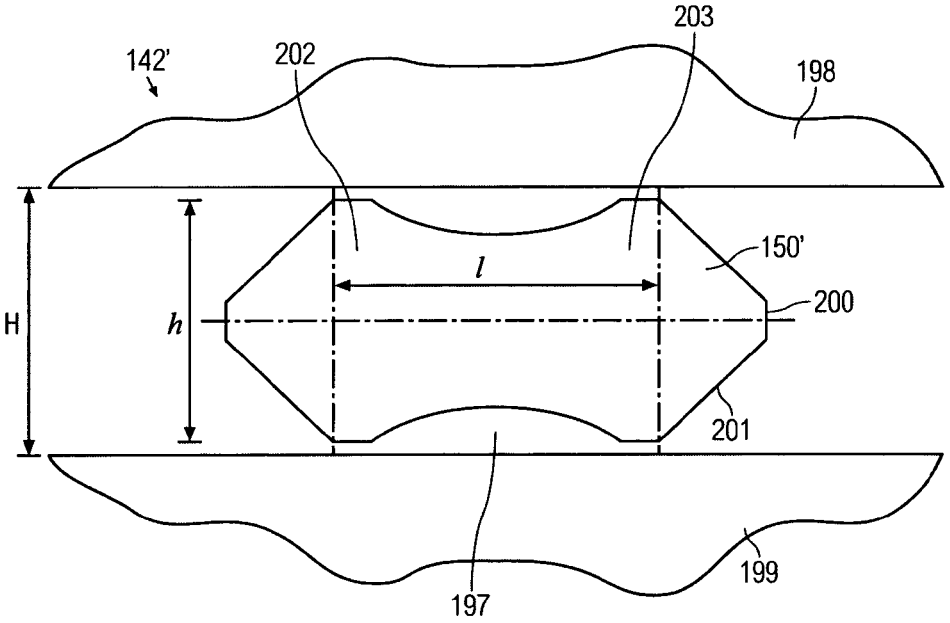
Figure 36:
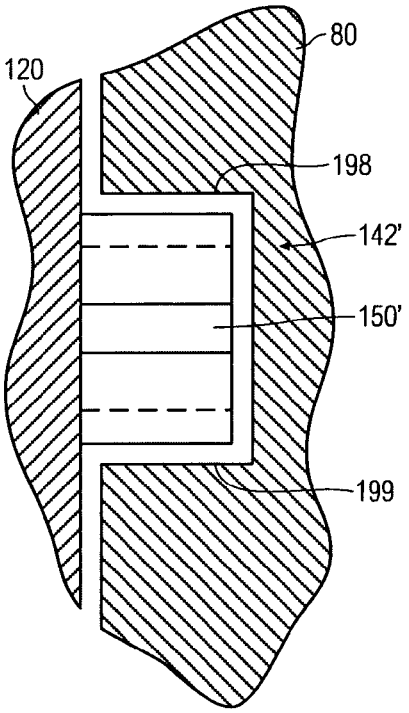
Figure 37:
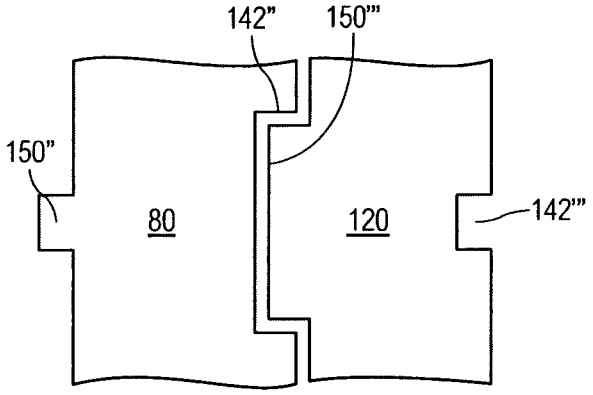

FIG. 1 illustrates a perspective view of a portion of an arrangement of grate bars with an exchangeable end cap, FIG. 2 illustrates an embodiment of an end cap having a thrust element and a clearing element, FIG. 3 illustrates a further embodiment of an end cap having a thrust element, FIG. 4 illustrates a further embodiment of an end cap having a clearing element, FIG. 5 illustrates a bottom view of the end cap of FIG. 2, FIG. 6 illustrates a further embodiment of a movable grate bar in front perspective, FIG. 7 illustrates a rear perspective view of the grate bar of FIG. 6, FIG. 8 illustrates a cross-sectional view through the distal end of a further embodiment of a grate bar, FIG. 9 illustrates a side view of a fixed grate bar, FIG. 10 illustrates a side view of a further embodiment of a movable grate bar in a first position, FIG. 11 illustrates a side view of the further movable grate bar of FIG. 10 in a second position, FIG. 12 illustrates a cross section of a first embodiment of grate bar grooves, FIG. 13 illustrates a cross section of a second embodiment of grate bar grooves, FIG. 14 illustrates a cross section of a third embodiment of grate bar grooves, FIG. 15 illustrates a side view of an arrangement of grate bar grooves of two neighbouring grate bars of FIGS. 9 and 10 in a first relative position, FIG. 16 illustrates a side view of an arrangement of the grate bars of FIG. 15 in a second relative position, FIG. 17 illustrates a side view of an arrangement of the grate bars of FIG. 15 in a third relative position, FIG. 18 illustrates a cross section through a reciprocating grate of a waste incineration plant, FIG. 19 illustrates a side view on a row of movable grate bars of the grate of FIG. 18, FIG. 20 illustrates a side view of a further embodiment of a grate bar having a coupling means, FIG. 21 illustrates a cross-sectional view of one of the two coupling means of the grate bar of FIG. 20, FIG. 22 illustrates a cross-sectional view of the other coupling means of the grate bar of FIG. 20, FIG. 23 illustrates shear forces which lead to the braking of a grate bar, FIG. 24 illustrates a broken grate bar of the grate of FIGS. 18 and 19 that is supported by neighbouring grate bars, FIG. 25 illustrates a frontal view of an arrangement of the grate bars of the grate of FIGS. 18 and 19, FIG. 26 illustrates a side view of an embodiment of an engaging element of the grate bars of FIG. 24, FIG. 27 illustrates a cross-sectional view along line A-A of the distal end of a further embodiment of a grate bar, FIG. 28 illustrates a side view of the grate bar of FIG. 27, FIG. 29 illustrates a cross-sectional view of the grate bar of FIG. 27, FIG. 30 illustrates a front perspective view of the grate bar of FIG. 27, FIG. 31 illustrates a cross-sectional view along line B-B of the second coupling means of the grate bar of FIG. 27, FIG. 32 illustrates a cross-sectional view along line C-C of the first coupling means of the grate bar of FIG. 27, FIG. 33 illustrates a cross-sectional view along line D-D of the first and second protrusions of the grate bar of FIG. 27, FIG. 34 illustrates a mounting of a row of grate bars into a step frame, FIG. 35 illustrates a further embodiment of an engaging element and a coupling element, FIG. 36 illustrates a cross section of FIG. 35, and FIG. 37 illustrates a further embodiment of engaging and coupling elements.

Figures in the figure descriptions below have similar parts. The similar parts have the same names or similar part numbers. For the sake of brevity, the description of the similar parts is not repeated every time.

FIG. 1 shows an arrangement 60 of grate bars 62, 63. The arrangement 60 shows two adjacent grate bars 62, 63. Each grate bar 62, 63 has a front face 65 and a plurality of lateral grooves 66.

The front face 65 comprises a lower vertical part 67 and an upper oblique part 68. An end cap 70 comprises two upwards facing portions, one horizontal portion 71 and one parallel portion 72 to the oblique part 68 of the front face 65.

The end cap 70 is secured to the grate bar 62 or 63 by bolts 176, 180 inserted from the underside of the upper part 16, as illustrated in FIGS. 2 to 4 and FIG. 28. The securing is such that the horizontal portion 71 abuts the upper part 16 and the parallel portion 72 abuts the oblique part 68.

As can be best seen in FIG. 1, the lateral grooves 66 are placed on both longitudinal sides of each grate bar 62, 63. The lateral grooves extend from the upper part 16 to a vertical part of the longitudinal projection 17. The lateral grooves 46 have an angle of inclination to the vertical such that the lateral grooves on one longitudinal side are inclined towards one end of the grate bar 62 or 63 while the lateral grooves in the opposite longitudinal side are inclined towards the other end of the grate bar 62 or 63.

In use, the end cap 70 is removable from grate bar 62 or 63 by removing bolts 176 and 180. Further embodiments of the end cap 70 are provided by the end caps 70', 70" or 70'" of FIGS. 2, 3 and 4.

The lateral grooves 66 serve to remove jammed material between the grate bars 62, 63 to beneath the grate bars 62, 63. This removal is achieved by the lateral grooves 66 of neighbouring grate bars 62, 63 moving in opposing directions. The relative movement cooperates to transport and comminute the waste material. The lateral grooves 46, 47 then channel the comminuted material below the grate bars 10. In addition, the lateral grooves 66 also allow air flow from underneath the grate bar 62, 63 to above the upper part 16 for providing combustion gas to the material to be combusted.

The distance between grooves 66 and the width of the grooves 66 are adapted such that any material received by the grooves 66 would be cut into pieces as the grate bars 62, 63 move relative to each other. The lateral grooves are provided along the whole length of the grate bars 62, 63 for providing combustion gas to the whole area of the grate 60.

FIG. 2 illustrates a further embodiment of an end cap 70 with a thrust element 174 and a clearing element 175. The thrust element 174 and the clearing element 175 are longitudinal protrusions with triangular shaped cross sections that are aligned perpendicular to the longitudinal axis of a grate bar 80, 120. Advantageously, the thrust and clearing elements are provided for non-stationary grate bars, that is to movable grate bars 120 and to fixed grate bars 80 which are attached to a movable step frame 170, as can be best seen in FIGS. 9-11 or FIGS. 18 and 19. The thrust element assists the backward movement and the circulation of the waste on the grate 60. The clearing element, on the other hand, assists the forward motion and the downward movement of the waste on the grate 60.

As can be seen in FIGS. 2, 3 and 4, a short bolt 176 and a long bolt 180 with respective bolt heads 177, 181 are provided inside the end cap 70, 70', 70", 70'". As shown in FIG. 3, the bolts 176, 180 are provided in T-shaped slits 179, 182 of the end cap 70, 70', 70", 70'". The lower parts of the T-shaped slits are formed by two L shaped protrusions 178 and two L-shaped protrusions 183 of the end cap 70, 70', 70", 70'". For simplicity, parts of the end caps 70' and 70'" that are similar to parts of the end cap 70" are not separately provided with reference numbers.

As shown in FIG. 4, washers are provided on the bolts 176, 180 and the respective nuts 185, 186 are screwed onto bolt threadings and later spot welded to the bolts 176, 180. In FIG. 4 the width of a receiving area 188 for the end cap 70, 70', 70", 70''', which is formed out of the upper part 16, is indicated by a length 1. On the side of the long bolt 180, the receiving area comprises a step 184. Gaps are provided between the L-shaped protrusions 178, 183 of the end cap 70 and the upper part 16. Furthermore, bores in the upper part 16 are made wider than the diameter of the bolts 176, 180. In this way, exact alignment of the protrusions 178, 183 and of the bolts 176, 180 is not required, alignment is provided by the steps 184 and 187 of the receiving area.

In a further embodiment of an end cap 70, which is not shown in FIGS. 2 to 4 but which can be seen in FIG. 1, the end cap 70 is not provided with a thrust element 174 or with a clearing element 175.

FIG. 5 shows a bottom view of FIGS. 2 and 3. The bolts 176 and 180 with respective bolt heads 177, 181 are provided in the T-shaped slits 179, 182 in a similar manner as curtain hooks in a curtain track and they are secured against horizontal movement by frictional engagement. The portions of the slits 179, 182 between the L-shaped protrusions 178, 183 have a smaller width than the diameter of the respective bolt heads 181, 177.

FIGS. 6 and 7 show a movable grate bar 10. Herein, "movable" refers to a movement relative to a step frame or to a supporting member. The supporting member is not shown in FIGS. 6 and 7 but it can be seen in FIGS. 10-11 which show a similar grate bar. The movable grate bar 10 has a left side 11, a right side 12, a front face 13, a distal end 14 and a proximal end 15. The movable grate bar 10 has an upper part 16 and a surmounting longitudinal projection 17. The proximal end 15 has two projecting noses 18, 19 downwardly projecting from the upper part 16. The upper part 16 of the movable grate bar 10 is downwardly disposed in the region of the projecting noses 18, 19.

At the distal end 14 of the movable grate bar 10, the upper part 16 and the longitudinal projection 17 extend to the front face 13 disposed at an angle to the upper part 16. The front face 13 has a retaining hole 20. The underside of the front end, not shown, has a flat, step-like groove 21. A first end cap 22 or a second end cap 23 may be removably affixed to front face 13 by means of an affixing means 24.

The first end cap 22 is approximately L-shaped in side elevation, having a left side comprising a lower face 48 and an upper face 49 and a lower side, not shown. The lower side has an upwardly projecting engaging lip 26 at the end of the lower side proximal to the lower face 48. The first end cap 22 has an attachment hole 27 extending from its upper face 49 to the underside of its upper face. The lower face 48 of first end cap 22 is oriented perpendicular to the upper side 16 of the movable grate bar 10 when it is mounted on the front face 13. The upper face 49 is disposed at an angle to the lower face 48.

The second end cap 23, which can be used as an alternative to the first end cap 22, is approximately L-shaped in side elevation, having a left side 25 and a lower side, not shown. The lower side has an upwardly projecting engaging lip 26 at the end of the lower side, not shown, proximal to the left side 25. Second end cap 23 has an attachment hole 27 extending from its left side 25 to the underside of its front end. The left side 25 of the second end cap 23 is flat and is perpendicular to the upper side 16 of the movable grate bar 10 when mounted on the front face 13.

The longitudinal projection 17 has six modified regions, a left proximal modified region 28, a left central modified region 29, a left distal modified region 30, a right proximal modified region 31, a right central modified region 32, and a right distal modified region 33. The left proximal modified region 28, the left central modified region 29, the left distal modified region 30, the right proximal modified region 31, the right central modified region 32 and the right distal modified region 33 are shaped as rips whose cross-sectional thickness is lower than the thickness of the other parts of the longitudinal projection 17. The surfaces of the regions 28, 29, 30, 31, 33, which serve to enhance the stability and which counteract bending under load, are unmachined. In contrast, the surfaces of the left side 11, the right side 12, and the longitudinal side 17 are smoothened.

The left and right proximal modified regions 28, 31 of the longitudinal projection 17 comprise a first protrusion 34 and a second protrusion 35 both extending downwardly from the lower side, not shown, of the longitudinal projection 17. The first protrusion 34 and second protrusion 35 have identical shape and form the left side 36 and back side, not shown, of the left and right proximal modified regions 28, 31. The left and right proximal modified regions 28, 31 further comprise an attaching hole 37 extending from the left proximal modified region 28 to the right proximal modified region 31. The front end 36 of both the first protrusion 34 and second protrusion 35 is disposed perpendicularly to the upper part 16 of the movable grate bar 10 and faces towards the front face 13.

A first engaging element 38 is disposed on the left side 11 of the longitudinal projection 17 situated longitudinally between the left proximal modified region 28 and left central modified region 29. The first engaging element 38 has a hole 39 extending in an axis between the distal end 14 and the proximal end 15 of the movable grate bar 10.

A second engaging element 40 is disposed on the left side 11 of the longitudinal projection 17 situated longitudinally between the left central modified region 29 and the left distal modified region 30. The second engaging element 40 has a hole 41 extending in an axis from the distal end 14 to the proximal end 15 of the movable grate bar 10.

A first grate bar coupling means 42 is disposed on the right side 12 of the longitudinal projection 17 situated longitudinally between the right distal modified region 31 and the right central modified region 32. The first grate bar coupling means 42 has a first elongated recess 43 with the axis of elongation from the distal end 14 to the proximal end 15 of the movable grate bar 10.

A second grate bar coupling means 44 is disposed on the right side 12 of the longitudinal projection 17 situated longitudinally between the right distal modified region 33 and the right central modified region 32. The second grate bar coupling means 44 has a second elongated recess 45 with the axis of elongation from the distal end 14 to the proximal end 15 of the movable grate bar 10.

A first set of three lateral grooves 46 extend from the left side 11 of the upper part 16 to the left central modified region 29. The first set of lateral grooves 46 has an angle of inclination to the vertical.

A second set of lateral grooves 47 extends from the left side 11 of the upper part 16 to the left proximal modified region 30. The second set of lateral grooves 47 has the same angle of inclination to the vertical as the first set of lateral grooves 46.

The lateral grooves 46 and 47 of FIG. 7 are similar to the grooves 66 shown in FIG. 1 and to the grooves 95 shown in FIG. 9. The grooves of the grate bars can be seen best in FIGS. 15, 16. 17. In FIG. 10 an angle of about 60° of the grooves against the vertical is indicated for this embodiment. The movable grate bar 10 further has a removable pyramidal element 50 that is attached to the distal end of the upper part 16. The pyramidal element 50 has four faces, inclined towards the front face 13, left side 11, right side 12 and proximal end 15 of the movable grate bar 10. The pyramidal element 50 can be attached to the upper part 16 by a nut and bolt arrangement 160 as illustrated in FIG. 8.

In use, several movable grate bars 10 are used in an incinerator for combusting material. In an arrangement of grate bars, each movable grate bar 10 is aligned with a horizontally adjacent fixed grate bar such that its left side 11, 17 abuts the right side 12, 17 of the neighbouring fixed grate bar. There is relative movement of one movable grate bar 10 with respect to the adjacent fixed grate bars. Herein, "fixed" refers to a movement relative to a step frame or supporting member, which means that a fixed grate bar moves together with the supporting member when the supporting member moves.

The pyramidal element 50 is used for improving the mixing of the material to be combusted and its transport velocity. It is designed such that it can be replaced without replacing the entire movable grate bar 10.

The first engaging element 38 engages the first elongated recess 43 and the second engaging element 40 engages the second elongated recess 45. Moreover, the first and second engaging elements 38, 40 can move within the first and second elongated recesses 43, 45 respectively in the axis of elongation of the elongated recesses 43, 45. In this arrangement of interconnected grate bars, relative movement of neighbouring grate bars in a longitudinal axis is possible. In the event that a movable grate bar 10 suffers a breakage, the engagement between the engaging elements and the coupling means enables the broken grate bar to continue to move relative to its neighbour and, therefore, prevent jamming of the system.

The upper part 16 is used for receiving material to be combusted and for aggravating the material to be combusted.

The left and right central modified regions 29, 32 allow combustion gas such as air from below the grate bar to access the upper part 16. Furthermore, the left and right central modified regions 29, 32 act as cooling fins for the upper part 16 via transferring heat from the upper part 16 to the left and right central modified regions 29, 32.

The left and right central modified regions 29, 32 enable the moving grate bar 10 to benefit from gas circulation in the region below the grate bar 10. This provides efficient heat transfer, thus increasing the lifespan of the grate bar 10.

The lateral grooves 46, 47 serve to let the combustion air pass via the grate bars 10 to the fuel in the furnace and to transport material that is jammed between the grate bars to beneath the grate bars 10.

The lateral grooves 46, 47 provide benefits of self-cleaning of jammed material from the upper part 16 and of providing gas to the upper part 16 of the grate bar 10. The lateral grooves 46, 47 are advantageously provided at the left central modified region 11, 17 and at the distal modified region 12, 17 respectively. This enables flow of air between the upper part 16 and beneath the grate bar 10.

The first end cap 22 or second end cap 23 is used to urge the received material for combusting forward. The first end cap 22 or second end cap 23 are also designed for removal from the front face 13 of the grate bar 10 for easy maintenance.

According to FIG. 1, a removable top 70, 71, 72 can be fitted to the grate bar 10 instead. The removable top 70, 71, 72 can be mounted and removed easily, compared to the first end second end caps 22, 23.

The removability of the end cap 22, 23 has the advantage that the whole grate bar need not be replaced when only the front face is worn out. This reduces material cost and system downtime. The front end of the grate bar 10 often suffers wear. The removability of the end cap 22, 23 also allows to use end caps of different types.

To improve securing of first end cap 22 or second end cap 23, the engaging lip 26 engages the groove 21. Further, affixing means 24 is inserted through attachment hole 27 of either the first end cap 22 or second end cap 23 and engages retaining hole 20.

FIG. 8 shows an arrangement for fixing a pyramidal element 50 to the distal end of a grate bar. The grate bar comprises a main body 190 which is shaped similar to an I-beam. The main body 190 comprises two rips that protrude downwards. As seen in FIG. 31, 32, 33, the upper indentation of the I-shape is provided to take up the removable head and behind the removable head, such as the pyramidal element, the main body 190 is shaped as a surface from which two or more rips protrude downwards.

A bore 194 is provided in the main body 190 for taking up a bolt 191. At the bottom side of the pyramidal element 50, a slit 192 is provided. The slit 192 has an enlarged upper portion 193. A head of the bolt 191 is provided in the enlarged upper portion 193 of the slit 192 and a nut 160 is provided at the bottom of the main body 190. A bolt 191 is provided in the bore 194 of the main body 190 and in the slit 192 of the pyramidal element 50 such that the bolt 191 passes through the nut 160. The nut 160 is spot welded to the bolt 191.

FIG. 9 illustrates a side view of a fixed grate bar 80 having an upper part 81 and 96, a front face 82, a surmounting longitudinal projection 83, 93, 94 and a supporting member 84. The supporting member comprises the portions 90, 91, 92.

At its proximal end, the upper part 81 is modified to form a downwardly extending hook 85. The longitudinal projection 83, 93, 94 has on one of its longitudinal sides three modified regions in which the thickness of the longitudinal projection 83 is reduced. These are a proximal modified region 86, a central modified region 87 and a distal modified region 88. These regions 86, 87 and 88 of reduced thickness extend from the lower side 89 of the longitudinal projection 83, 93, 94 to a point between the lower side of the longitudinal projection 89 and the upper part 81 such that the thickness of the upper part 81 is not reduced.

The supporting member 84 has a horizontally extending portion 90 and a vertically extending portion 91. One end of the horizontally extending portion 90 extends from a middle part of the vertically extending portion 91. An upper part 92 of the vertically extending portion 91 is adapted to support the proximal end of the fixed grate bar 80. The supporting member 84 may be provided by the cross section of a carrier beam.

A left side 93 of the fixed grate bar 80 has a left external surface 94, which extends from the proximal end to the distal end of the fixed grate bar 80. The left external surface 94 has a plurality of lateral inclined grooves 95. The lateral inclined grooves 95 extend from the upper surface 96 of the fixed grate bar 80 to the lower surface 98 of the fixed grate bar 80. The left external surface 94 has a first engaging element 100 disposed between the proximal modified region 86 and the central modified region 87 and second engaging element 101 disposed between the central modified region 87 and the distal modified region 88.

Similarly, a right side, which is not shown, of the fixed grate bar 80 has a right external surface which extends from the proximal end to the distal end of the fixed grate bar 80. The right external surface has a plurality of lateral inclined grooves 126 which have an opposite inclination to the grooves 95. These lateral inclined grooves 126 extend from the upper surface 96 of the fixed grate bar 80 to the lower surface 98 of the fixed grate bar 80.

The right external surface, not shown, has a first coupling means, not shown, disposed between the proximal modified region 86 and the central modified region 87 and second coupling means, not shown, disposed between the central modified region 87 and the distal modified region 88.

On the side of the grate bar, which is not shown in FIG. 9, first and second coupling means are provided, similar to the coupling means 42, 44 shown in FIG. 6.

In the embodiment of FIGS. 9, 10, 11, left and right lateral inclined grooves are inclined at an angle to the vertical. Furthermore, the inclination of all grooves of one type of grate bars is in one direction while the inclination of the grooves of the other type of grate bars is in the opposite direction. Hence, the inclination of the grooves is the same for both sides of a grate bar of a given type.

FIGS. 10 and 11 show a side view of a further embodiment of a movable grate bar 120 in a first and second position respectively. The grate bar 120 has parts similar to parts of the fixed grate bar 80 of FIG. 9.

The upper part 81 of grate bar 120 is modified at its proximal end to form a downwardly extending portion 122. Further, a protrusion 124 is downwardly disposed at the proximal end of the grate bar 120 extending downwardly from a lower side of the longitudinal projection 83.

The downwardly extending portion 122 and a vertical part of the protrusion 124 define a space such that the upper part 92 of the vertically extending portion 91 of the supporting member 84 can move within the space. The movement 196 is such that the upper part 92 can abut either with the protrusion 124, as illustrated in FIG. 10, or with the downwardly extending portion 122, as illustrated in FIG. 11. In contrast, the fixed grate bars 80 according to FIG. 9 are fixed relative to the supporting member 84. Therefore, if a fixed grate bar 80 is placed horizontally adjacent to a movable grate bar 120, a relative movement between the grate bars 80 and 120 is created during operation.

Similar to the fixed grate bar 80 of FIG. 9, the left external surface 94 of the movable grate bar 120 has a plurality of lateral inclined grooves 126. The lateral inclined grooves 126 extend from the upper surface 96 of the movable grate bar 120 to the lower surface 98 of the movable grate bar 120.

Likewise, a right side, not shown, of the grate bar 120 has a right external surface, not shown, which extends from the proximal end to the distal end of the grate bar 120. The right external surface has a plurality of lateral inclined grooves 126, not shown. These lateral inclined grooves 126 extend from the upper surface 96 of the movable grate bar 120 to the lower surface 98 of the movable grate bar 120.

As mentioned before, the lateral inclined grooves 95 or 126 are inclined at an angle to the vertical such that the lateral inclined grooves 95 at both sides of the grate bar 80 or of the grate bar 120 are inclined in the same direction, respectively. The lateral inclined grooves 126 of the grate bar 120 of FIGS. 10 and 11 are opposingly inclined to lateral inclined grooves 95 of the fixed grate bar 80 of FIG. 9.

In general, the movable grate bar 120 can have two identical protrusions 124 for lateral stability, as illustrated in FIG. 33. The fixed grate bars 80 and movable grate bars 120 can have different supporting members 84.

In use, each supporting member 84 is intended for supporting a plurality of the grate bars 80 and 120. The plurality of the grate bars 80 and 120 are arranged such that one fixed grate bar 80 is placed horizontally adjacent to a movable grate bar 120, as illustrated in FIG. 25.

The supporting member 84 serves to move the grate bars 80 or 120 back and forth in a longitudinal direction of the grate bar 80 or 120, respectively. The back and forth movement is used for stirring material that is placed on the upper part 96 of the grate bar 80, 120 for combustion.

In a forward movement step, the supporting member 84 moves from a first end to a second end. The upper part 92 of the vertically extending portion 91 of the supporting member 84 then abuts the longitudinal projection 83 of the movable grate bar 120 to move the movable grate bar 120 in the same direction as the supporting member 84. The upper part 92 also abuts the protrusion 124 of the fixed grate bar 80 to move in the same direction, as illustrated in FIG. 10.

In a backward movement step, the supporting member 84 moves from the second end to the first end. The upper part 92 of the vertically extending portion 91 of the supporting member 84 abuts the downwardly extending hook 85 of the fixed grate bar 80 to move the fixed grate bar 80 in the same direction as the supporting member 84. The upper part 92 also abuts the downwardly extending portion of the movable grate bar 120 to move in the same direction at a later time, as illustrated in FIG. 11. This is because of the time needed for the upper part 92 to move within the space between the protrusion 124 and the downwardly extending portion 122.

In other words, in the backward movement step, the movable grate bar 120 will start to move after the fixed grate bar 80. Similarly, in the subsequent forward movement step the movable grate bar 120 will start to move after the fixed grate bar 80. The forward and backward steps are repeated. This arrangement achieves comminution and transport of the waste material.

The left lateral inclined grooves 95 of the fixed grate bar 80 are intended to cooperate with the right lateral inclined grooves 126 of the grate bar 120 to receive and to comminute combustion material, as the grate bars 80 and 120 move relative to each in the manner described above.

Receiving of the combusted material can occur in a first position, when the upper end of the right lateral inclined grooves 126 and the upper end of the left lateral inclined grooves 95 align or coincide with each other, as illustrated in FIG. 15. This creates a receiving volume 128 defined by the abutting sides of the neighbouring grate bars 80 and 120 and their respective lateral inclined grooves 95 and 126.

As shown in FIGS. 15, 16, 17, a conveying volume 130 that is defined by an intersection of the inclined grooves moves upwards and downwards during operation. Big waste particles that are trapped in the grooves 95, 126 move upwards and downwards in the conveying volume 130 until they are moved to the top or bottom of the grate bars or until they are sheared apart into smaller particles. Smaller particles which are trapped in the grooves fall through the grooves 95, 126 to beneath the grate bars and/or are sheared apart as well.

The cutting of material which is caught in the grooves 95, 126 occurs when the side edges of the adjacent grooves 95, 126 move towards each other. The relative movement of two adjacent grooves 95, 126 provides an increase of the cutting forces due to the angular relationship between the cutting forces and the inclination of the grooves 95, 126. A corresponding cutting angle $\beta$ is indicated in FIG. 16, which is about 90° in this embodiment. It may be made smaller than 90° to facilitate air transport. The thrust force of the movable step frame is converted into a normal cutting force which is perpendicular to the grooves 95, 126 and into an advancing force which is parallel to the grooves 95, 126. This improves the cleansing of the grooves 95, 126.

FIGS. 12, 13 and 14 show cross sections of several embodiments of grate bar grooves 95, 126. The cross sections have rectangular, sawtooth and rounded sawtooth shapes. The grate bar grooves 95, 126 with rectangular cross section shown in FIG. 12 are especially advantageous. They provide a good throughput of air, cutting edges on both sides and are easy to machine. To achieve a good throughput of air it is furthermore advantageous to provide air ducts in the form of grate bar grooves 95, 126 in the surface that abuts to the adjacent grate bar along at least the larger part of the surface's longitudinal extension, as shown in FIGS. 9 and 10.

The cross section of one groove is calculated according to a formula as follows. A gas flow model is used to compute the sum of all cross sections of grooves of a grate bar such that the total cross section is large enough to provide enough combustion air according to the gas flow model. The single cross section is obtained by division of the total cross section by the number of grooves and multiplication times a correction factor of 1/0.6-1/0.85 or of 1/0.7-1/0.85 that takes into account the resistance of the groove which depends on the shape of the groove.

FIG. 18 shows a cross section of a reciprocating grate 161 of a waste incineration plant. Movements of the grate bars are indicated by arrows as well as the movement of a lever 173.

In the cross section shown, all grate bars are fixed grate bars 80. Horizontally adjacent grate bars, which are located in a cross section in front of the shown cross section and in a cross section behind the shown cross section, are designed as movable grate bars 120 as can be best seen in FIG. 19. A driven set of fixed grate bars 280 that comprises every second fixed grate bar 80 is supported by a movable step frame 170. A non-driven set of fixed grate bars 281 that comprises every intermediate fixed grate bar is supported by a fixed step frame 171. The movable step frame 170 and the fixed step frame 171 comprise T-shaped supporting members. The frames 170, 171 may be formed in such a way that the T-shaped supporting members 84 are provided by the cross section of the frames 170, 171.

In operation, the driven set of fixed grate bars 280 is moved forwards and backwards by the T-shaped supporting members 84 of the movable step frames 170 whilst the non-driven set of fixed grate bars 281 is kept in position by the T-shaped supporting members 84 of the fixed step frames 171.

Likewise, the horizontally adjacent grate bars, three of which can be seen in FIG. 19, comprise a driven set of movable grate bars 220 and a non driven set of movable grate bars 221 which comprise every second movable grate bar 120 and every intermediate movable grate bar 120, respectively. The driven set of movable grate bars 220 is supported by the movable step frame 170 and the non-driven set of movable grate bars 221 is supported by the fixed step frame 171.

In operation, the driven set of movable grate bars 220 is moved forwards and backwards by the T-shaped supporting members 84 whilst the non-driven set of movable grate bars 221 is moved back and forth by the nose shaped protrusions 124 of the driven set of movable grate bars 220 and by the weight of the grate bars 120. The movable grate bars 120 of the non-driven set of movable grate bars 221 are movable between an upper and a lower end position that is determined by the space between the downwardly extending portion 122 and the nose shaped protrusion 124 in which the T-shaped supporting member 84 engages.

The supporting members 84 of the driven sets of grate bars 220 are connected to a driving beam 172 which is connected to a push rod 162. The push rod 162 is in turn connected to a motor (not shown) which generates a reciprocating motion via the lever 173.

FIG. 19 shows three succeeding movable grate bars 120. The movable grate bars 120 at the bottom and at the top are resting on a fixed step frame 171 and the movable grate bar 120 in the middle is resting on a movable step frame 170. It is shown that the movable grate bars 120 at the top rest on the nose shaped protrusion 124 of the movable grate bar 120 in the middle.

FIG. 20 shows a side view of a further embodiment of the grate bar of FIG. 9. FIG. 20 shows a grate bar 140 that has similar parts to the fixed grate bar 80 of FIG. 9. The grate bar 140 includes coupling means 142, 144 that have elongated recesses 146, 148 respectively. The elongated recesses 146, 148 are engaged to engaging elements 150, 152 respectively, as illustrated in FIGS. 21 and 22.

FIG. 21 shows a first cross section through a grate bar 140 close to the engaging element 152 at the proximal side whilst FIG. 22 shows a second cross section through the grate bar 140 close to the engaging element 150 at the distal side. According to FIG. 22, the cross section at the distal side is wider than the cross section at the proximal side shown in FIG. 21. However, the cross sections of FIGS. 21 and 22 may be made equal.

In use, the engaging elements 150, 152 can move within the elongated recesses 146, 148 of the coupling means 142, 144.

FIG. 23 shows a top view of a fixed grate bar 80, a movable grate bar 120 and a fixed grate bar 80'. The fixed grate bar 80 is movably supported at a fixed step frame 171 via engaging elements, that are not shown in FIG. 23. A waste chunk 102 is trapped between the fixed grate bar 80 and the movable grate bar 120. The waste chunk 102 is wider than the small gap between the fixed grate bar 80 and the movable grate bar 120 and bends the movable grate bar 120 and the adjacent fixed grate bar 80' to the right along the bending lines 103, 103'. Thereby, a bending moment is exerted onto the grate bars 120, 80' which is strongest in the region of the bending line. The bending moment may eventually lead to breaking of the movable grate bar 120. Thermal stress increases the wear on the grate bars 120, 80' which are usually made from cast iron. Cast iron is relatively brittle and does not bend readily under deformation forces.

FIG. 24 shows a broken grate bar 120 which is supported by engaging elements 150, 152 that engage into the elongated recesses 146, 148 of a neighbouring grate bar 80 and by the engaging elements 150, 152 of a neighbouring grate bar 80' that engage into the elongated recesses 146, 148 of the broken grate bar. The rupture line of the broken grate bar runs between the engaging elements of the broken grate bar, which is indicated by a zigzag line. The first broken piece is held in place by the engagement elements 152 on both sides of the first broken piece and the second broken piece is held in place by the engagement elements 150 on both sides of the second broken piece. Thereby, both of the broken pieces are prevented from falling down and the waste plant can continue to operate. As long as the broken pieces are not damaged too much, they stay together, such that waste is prevented from falling through between the broken pieces. For the first and the last grate bar of a horizontal row, engaging elements and/or coupling means can be provided at side walls of the grate.

FIG. 25 shows a frontal view onto a horizontal row of grate bars. Fixed grate bars 80 alternate with movable grate bars 120. The fixed grate bars 80 engage with the movable grate bars 120 through engaging elements 150 and coupling means 142 which are indicated by dashed lines.

FIG. 26 shows a side view of an embodiment the grate bar 80 of FIG. 25. FIG. 26 depicts an engaging element 150 that comprises an octagonal protrusion 157. Elongated recesses and grate bar coupling means of 142 of the broken grate bar of FIG. 25 are shown by dashed lines. The octagonal protrusion 157 engages into the elongated recess 146 of the broken grate bar. The two parts of the broken grate bar 80 tilt under their own weight until the elongated recess 146 contacts two opposite edges F of the octagonal protrusion 157 and they are therefore prevented from tilting further. In FIG. 26, the two contact points are indicated by arrows F. The same effect occurs for the octagonal protrusion 157 on the other side of the broken grate bar 80 that engages into an elongated recess 142 of a neighbouring grate bar 120 and in a similar way for fixed grate bars 80 as for movable grate bars 120.

In use, the engaging element 155 experiences shear forces as it engages with a corresponding coupling means. The octagonal protrusion 157 provides a larger contact area with the coupling means such that wear due to the shear forces is reduced.

As neighbouring grate bars move relative to each other, material which is trapped between the grate bars is moved against the octagonal protrusion 157. The edges of the octagon provide a cutting effect. Furthermore, the four sides of the octagonal protrusion 157 that are slanted against the horizontal deflect the material towards the top and towards the bottom as it moves against the octagonal protrusion 157. This provides an improved self-cleaning of the elongated recess 146.

FIGS. 27 to 29 illustrate different views of the grate bar of FIG. 1. Parts that are similar in FIGS. 27 and 33 and the aforegoing figures do not comprises separate reference numerals. FIG. 30 shows a cross-sectional view along line A-A of the distal end of the grate bar of FIG. 28. FIG. 31 shows a cross-sectional view along line B-B of the second coupling means of the grate bar of FIG. 28. FIG. 32 shows a cross-sectional view along line C-C of the first coupling means of the grate bar of FIG. 28. FIG. 33 shows a cross-sectional view along line D-D of the first and second protrusions of the grate bar of FIG. 28.

FIGS. 31 and 32 show cross sectional views through the grate bar at points along the bar where coupling means are located. In FIGS. 31 and 32 the elongated recesses 43, 45 of FIG. 6 are shown whilst the corresponding engaging elements 38, 40 of FIG. 6 are left out for clarity. The engaging elements are removable, as shown in FIGS. 9 and 10.

FIG. 34 shows a top view of the mounting of a row of grate bars 80, 120 into a step frame. Side bars 105, 106 of a step frame and the upper part 92 of a T-shaped profile of the step frame are shown from above.

The mounting process is essentially the same for movable step frames and for fixed step frames. For mounting, one of the side bars 105, 106 is bend outwards with a lever that is not shown here. In the example of FIG. 34, the right side bar 106 is bend outwards. Then, the grate bars of a row of alternating fixed and movable grate bars 80, 120 are inserted, one after another. During insertion, the engaging elements 150, 152 of a grate bar is inserted into the respective elongate recesses 42, 45 of the left neighbouring grate bar or of the left side bar 105. After insertion of the last grate bar of a row, the pressure of the lever is lowered such that the right side bar 106 bends back inwards.

In a modification of the embodiment of FIG. 34, the placement of the engaging elements 150, 152 and the elongated recesses is reversed. In another modification, the placement of the fixed and movable grate bars in a row is reversed. The alternating placement of fixed and movable grate bars can also be made such that there is always a fixed grate bar 80 next to a side bar 105, 106. Then, the grate bars 80 can be fixed to the side bars 105, 106. In this case, it is preferable to use an odd number of grate bars in a row. The grate bars may also be inserted in groups.

FIG. 35 shows a further embodiment of an engaging element 150' of a grate bar. The engaging element 150' has a bone-like form with a neck 197 in the middle. This form may be chosen to save weight, for example. In the embodiment of FIG. 35, the coupling element is formed out by two protrusions 198, 199 that extend along the length of a neighbouring grate bar 80. The protrusions 198, 199 form a track between them which has a height H.

Similar to the octagonal element 150 shown in FIG. 261, the engaging element 150' comprises front faces 200 and slanted faces 201. The engaging element 150' comprises two ends 202, 203 which are defined by the maximum vertical extension h perpendicular to the longitudinal axis of the engaging element 150'. The distance between the ends is indicated by a length l and the vertical extension at the ends is indicated by a height h.

It can be shown through geometrical considerations that for a rectangular shape of an engaging element, the maximum angle of inclination a is approximately given by the relation $H=l\sin(\alpha)+h*\cos(\alpha)$, wherein l is the width of the rectangle and h is the height of the rectangle. It is desirable, to have a small angle of maximum inclination. This can be achieved by making l greater than H. A similar consideration applies for the octagonal shape of FIG. 26, the shape of FIG. 35 or other shapes of the engaging element.

FIG. 36 shows a cross section through the two neighbouring grate bars 80, 120 which comprise the coupling means 142' and the engaging element 150'. By way of example, the grate bar with the engaging element 150' is shown as a movable grate bar and the grate bar with the coupling means 142' is shown as a fixed grate bar 80.

FIG. 37 shows a further modification in which a coupling means 142" is dimensioned bigger than an engaging element 150" on the opposite side of a grate bar 80. For a neighbouring grate bar 120, the engaging element 150'" is dimensioned bigger than the coupling means 142'" to match with the coupling means 142" and the engaging element 150", respectively.

Although the above description contains much specificity, this should not be construed as limiting the scope of the embodiments but merely providing illustration to the embodiments. The above stated advantages of the embodiments should not be construed as limiting the scope of the embodiments but merely to explain possible achievements if the described embodiments are put into practise. Thus, the scope of the embodiments should be determined by the claims and their equivalents, rather than by the examples given.

Further aspects and objects of the present application are disclosed in the below mentioned item list.

1. Grate bar for a furnace comprising
   - a proximal elongated recess at a first side of the grate bar and
   - a proximal engaging element at a second side of the grate bar, the second side being opposite to the first side,
   - wherein the proximal elongated recess being provided in a longitudinal direction of the grate bar such that a corresponding neighbouring proximal engaging element of a first neighbouring part being movable within the proximal elongated recess in the longitudinal direction relative to the grate bar,
   - wherein the proximal engaging element has a longitudinal shape with a first end and a second end, wherein the height of the proximal engaging element at the first end and at the second end being slightly smaller than the height of a corresponding proximal elongated recess of a further neighbouring part.
2. Grate bar according to item 1, further comprising a distal elongated recess and a distal engaging element.

3. Grate bar according to one of the preceding items, wherein at least one coupling element is adapted to the corresponding engaging element of the first neighbouring grate part such that the elongated recess can only tilt relative to the engaging element of the first neighbouring part by a tilt angle that does not exceed a maximum tilt angle, and wherein at least one engaging element is adapted to the corresponding coupling element of the second neighbouring part such that the engaging element can only tilt relative to the elongated recess of the second neighbouring part by a tilt angle that does not exceed the maximum tilt angle.

4. Grate bar according to one of the preceding items, wherein the engaging element has a rectangular cross section, wherein a height of the rectangular cross section is slightly smaller than the height of the corresponding elongated recess and a width of the rectangular cross section is greater than the height of the corresponding elongated recess.

5. Grate bar according to one of the items 1 to 3, wherein at least one of the engaging elements has an octagonal cross section, a height of the octagonal cross section being slightly smaller than the height of the corresponding elongated recess and a width of a longitudinally aligned surface of the engaging element being greater than the height of the corresponding elongated recess.

6. Grate bar according to one of the items 1 to 3, wherein at least one of the engaging elements has a bone shaped cross section, the bone shaped cross section comprising to widened ends, a height of the widened ends being slightly smaller than the height of the corresponding elongated recess and a distance of the widened ends being greater than the height of the corresponding elongated recess.

7. Grate bar according to one of the items 2 to 6 wherein the proximal engaging element is provided next to a proximal end of the grate bar and the distal engaging element is placed next to a distal end of the grate bar and wherein the proximal end of the grate bar is in contact with a supporting element and the distal end of the grate bar is in contact with an upper surface of a further grate bar.

8. Grate bar according to one of the preceding items, wherein the elongated recesses are formed out as a gap between two longitudinal protrusions that extend along the grate bar.

9. Grate bar according to one of the preceding items, wherein the elongated recesses are formed out as a proximal elongated recess and a distal elongated recess, the recesses having an O-shaped cross section.

10. Grate bar according to one of the preceding items, wherein the elongated recesses are formed out as a proximal elongated recess and a distal elongated recess, the recesses having a rectangular cross section.

11. Grate bar according to one of the preceding items, wherein the recess is formed out as protrusion of the main body of the grate.

12. Grate bar according to one of the items 2 to 11, wherein the proximal engaging element is provided at a distance of about 40 cm from the distal engaging element.

13. Grate for a furnace, the grate comprising an arrangement of fixed and movable grate bars, the fixed and movable grate bars comprising longitudinal recesses and engaging elements according to one of the preceding items, the engaging elements of a grate bar engaging into the longitudinal recesses of a neighbouring part.

14. Grate for a furnace according to item 13, further comprising a frame, the frame comprising engaging elements, the engaging elements mating with elongated recesses of adjacent grate bars.

15. Grate for a furnace according to item 13, further comprising a frame, the frame comprising elongated recesses, the elongated recesses mating with engaging elements of adjacent grate bars.

16. Waste incineration plant with an arrangement of fixed and movable grate bars according to item 15.

17. Grate bar for a furnace, comprising an exchangeable head at a distal end of the grate bar, the exchangeable head being fixed to the grate bar with at least two bolts, the bolts comprising bolt heads which engage into a first and a second T-shaped slit that are provided in the exchangeable head, wherein the exchangeable head is provided between a first step and a second step of a receiving area of the grate bar.

18. Grate bar according to item 17, wherein the exchangeable head is provided within an indentation formed out of a main body of the grate bar, the main body having an H-shaped profile at its distal end.

19. Grate bar according to item 17 or item 18, wherein at least one front bolt and at least one rear bolt are provided, the at least one front bolt being shorter than the at least one rear bolt, the at least one front bolt engaging into the first T-shaped slit and the at least one rear bolt engaging into the second T-shaped slit.

20. Grate bar according to one of the items 17 to 19, wherein the bolts are spot welded to the grate bar.

21. Grate bar according of the items 17 to 20, wherein the exchangeable head comprises a thrust element at sloping surface of the exchangeable head.

22. Grate bar according to item 21, wherein the thrust element has a triangular cross section.

23. Grate bar according to one of items 17 to 22, wherein the exchangeable head comprises a clearing element at a horizontal surface of the exchangeable head.

24. Grate bar according to item 23, wherein the clearing element has a triangular cross section.

25. Grate bar according to one of items 17 to 24, wherein the exchangeable head comprises a pyramidal portion.

26. Grate bar according to one of items 17 to 25, wherein the bolts are provided in bores of the grate bar such that a clearance is left between the bolts and the bores.

| References | |
|---|---|
| 10 | movable grate bar |
| 11 | left side |
| 12 | right side |
| 13 | front face |
| 14 | distal end |
| 15 | proximal end |
| 16 | upper part |
| 17 | longitudinal projection |
| 18 | projecting nose |
| 19 | projecting nose |
| 20 | retaining hole |
| 21 | groove |
| 22 | first end cap |
| 23 | second end cap |
| 24 | affixing means |
| 25 | left side |
| 26 | engaging lip |
| 27 | attachment hole |
| 28 | left proximal modified region |
| 29 | left central modified region |
| 30 | left distal modified region |
| 31 | right proximal modified region |
| 32 | right central modified region |
| 33 | right distal modified region |
| 34 | first protrusion |
| 35 | second protrusion |

-continued

| References | |
|---|---|
| 37 | attaching hole |
| 38 | first engaging element |
| 39 | hole |
| 40 | second engaging element |
| 41 | hole |
| 42 | first grate bar coupling means |
| 43 | first elongated recess |
| 44 | second grate bar coupling means |
| 45 | second elongated recess |
| 46 | lateral grooves |
| 47 | lateral grooves |
| 48 | lower face |
| 49 | upper face |
| 50 | pyramidal element |
| 60 | arrangement or grate |
| 62 | grate bars |
| 63 | grate bars |
| 65 | front face |
| 66 | lateral grooves |
| 67 | lower vertical part |
| 68 | upper oblique part |
| 70 | end cap |
| 71 | horizontal portion |
| 72 | parallel portion |
| 80 | fixed grate bar |
| 81 | upper part |
| 82 | front face |
| 83 | longitudinal projection |
| 84 | supporting member |
| 85 | downwardly extending hook |
| 86 | proximal modified region |
| 87 | central modified region |
| 88 | distal modified region |
| 89 | lower side |
| 90 | horizontally extending portion |
| 91 | vertically extending portion |
| 92 | upper part |
| 93 | left side |
| 94 | left external surface |
| 95 | left lateral inclined grooves |
| 96 | upper surface |
| 98 | lower surface |
| 100 | first engaging element |
| 101 | second engaging element |
| 102 | waste chunk |
| 103 | bending line |
| 105 | step frame side bar |
| 106 | step frame side bar |
| 120 | movable grate bar |
| 122 | downwardly extending portion |
| 124 | protrusion |
| 126 | left lateral inclined grooves |
| 128 | receiving volume |
| 130 | conveying volume |
| 132 | opening |
| 140 | grate bar |
| 142 | coupling means |
| 142' | coupling means |
| 144 | coupling means |
| 146 | elongated recess |
| 148 | elongated recess |
| 150 | engaging element |
| 150' | engaging element |
| 152 | engaging element |
| 155 | engaging element |
| 157 | octagonal protrusion |
| 159 | cylindrical protrusion |
| 160 | nut |
| 161 | reciprocating grate |
| 162 | push rod |
| 165 | rapture line |
| 170 | movable step frame |
| 171 | fixed step frame |
| 172 | driving beam |
| 173 | lever |
| 174 | thrust element |
| 175 | clearing element |

-continued

| References | |
|---|---|
| 176 | short bolt |
| 177 | bolt head |
| 178 | L-shaped protrusions |
| 179 | T-shaped slit |
| 180 | long bolt |
| 181 | bolt head |
| 182 | T-shaped slit |
| 183 | L-shaped protrusions |
| 184 | edge of upper part 16 |
| 185 | nut |
| 186 | nut |
| 187 | edge |
| 188 | receiving area |
| 190 | main body |
| 191 | bolt |
| 192 | slit |
| 193 | enlarged portion of slit |
| 194 | bore |
| 196 | relative movement |
| 197 | neck |
| 198 | protrusion |
| 199 | protrusion |
| 200 | front face |
| 201 | slanted face |
| 202 | end |
| 203 | end |
| 220 | driven movable set |
| 221 | non-driven movable set |
| 280 | driven fixed set |
| 281 | non-driven fixed set |

The invention claimed is:

1. A grate arrangement for a furnace, the grate arrangement comprising:

a first grate bar, the first grate bar including a front end, a back end distal from the front end, an upper surface extending from the front end to the back end, a lower surface extending from the front end to the back end and distal from the upper surface, and a first lateral side defined between the upper surface, the lower surface, the front end, and the back end, the first lateral side defining first grooves extending from top openings in the upper surface to bottom openings in the lower surface, wherein the first grooves are inclined in the first lateral side with the top openings positioned towards the front end of the first grate bar relative to the bottom openings;

a second grate bar, the second grate bar horizontally adjacent to the first grate bar, the second grate bar including a front end, a back end distal from the front end, an upper surface extending from the front end to the back end, a lower surface extending from the front end to the back end and distal from the upper surface, and a second lateral side defined between the front end, the back end, the upper surface, and the lower surface, the second lateral side facing the first lateral side of the first grate bar, the second lateral side defining second grooves extending from top openings in the upper surface to bottom openings in the lower surface, wherein the second grooves are inclined in the second lateral side with the top openings positioned towards the back end of the second grate bar relative to the bottom openings, and wherein an intersection of the first grooves with the second grooves defines a conveying volume; and supporting members configured to support the first and second grate bars and configured to generate a relative motion between the horizontally adjacent first and second grate bars between a first position and a second position, wherein at the first position, the top openings of the first grooves intersect with the top openings of the second grooves to define the conveying volume, and wherein at the second position, the bottom openings of the first grooves intersect with the bottom openings of the second grooves to define the conveying volume.

2. The grate arrangement according to claim 1, wherein the first grooves are inclined at an angle of 60° in the first lateral side and the second grooves are inclined at an angle of 60° in the second lateral side, wherein a first side edge of one of the first grooves and a second side edge of one of the second grooves define a cutting angle, and wherein the cutting angle defined by the first side edge and the second side edge is 60°.

3. The grate arrangement according to claim 1, wherein the first lateral side defines a smooth surface in which the first grooves are defined and the second lateral side defines a smooth surface in which the second grooves are defined.

4. The grate arrangement according to claim 1, further comprising:

a driving beam configured to move the first and second grate bars; and a motor configured to generate a reciprocating motion, wherein the motor is connected to the driving beam.

* * * * *